US010472749B2

(12) United States Patent
Lonati et al.

(10) Patent No.: US 10,472,749 B2
(45) Date of Patent: Nov. 12, 2019

(54) DEVICE FOR FEEDING THREAD TO NEEDLES OF A KNITTING MACHINE

(71) Applicant: SANTONI S.P.A., Brescia (IT)

(72) Inventors: Tiberio Lonati, Brescia (IT); Fausto Lonati, Brescia (IT); Ettore Lonati, Botticino (IT)

(73) Assignee: SANTONI S.P.A., Brescia (IT)

( * ) Notice: Subject to any disclaimer, the term of this patent is extended or adjusted under 35 U.S.C. 154(b) by 0 days.

(21) Appl. No.: 14/899,324

(22) PCT Filed: Jun. 17, 2014

(86) PCT No.: PCT/IB2014/062287
§ 371 (c)(1),
(2) Date: Dec. 18, 2015

(87) PCT Pub. No.: WO2014/203158
PCT Pub. Date: Dec. 24, 2014

(65) Prior Publication Data

US 2016/0130735 A1 May 12, 2016

(30) Foreign Application Priority Data

Jun. 21, 2013 (IT) ..... BS2013A0086

(51) Int. Cl.
*D04B 15/60* (2006.01)
*D04B 15/38* (2006.01)

(52) U.S. Cl.
CPC ..... *D04B 15/38* (2013.01); *D04B 15/60* (2013.01)

(58) Field of Classification Search
CPC ..... D04B 15/38; D04B 15/565; D04B 15/60; D04B 15/48; D04B 15/58; D04B 15/54
(Continued)

(56) References Cited

U.S. PATENT DOCUMENTS 244,736 A * 7/1881 Bradley ..... D04B 15/60 66/140 R
1,340,681 A * 5/1920 Pigeon ..... D04B 15/38 66/131

(Continued)

FOREIGN PATENT DOCUMENTS

DE 102004033655 A * 2/2005 ..... D04B 15/58
EP 0319444 A2 6/1989

(Continued)

*Primary Examiner* — Megan E Lynch
(74) *Attorney, Agent, or Firm* — Pearne & Gordon LLP

(57) ABSTRACT

A device (1) for feeding thread to the needles (N) of a knitting machine, the device comprising a body (2) destined to be associated to a needle-bearing organ of the knitting machine, and provided with at least a housing seating (3) configured such as to movably house the thread guide means (4) in the body. The device is provided with thread guide means (4), movably housed in the housing seating (3) and comprising a first lever (5), a thread guide (6) and a second lever (10). The first lever is rotatably mounted to the body (2) such as to be able to rotate about a first rotation axis (X); the thread guide is rotatably mounted to the first lever (5) so as to be able to rotate, with respect to the first lever, about a second rotation axis (Y). The thread guide extends longitudinally between a rear end (7) and a front end (8); the front end (8) extends and emerges from the seating (3) in the direction of the needle-bearing organ, and defines at least a passage (61) for a thread to be dispensed to the needles (N) of the needle-bearing organ; the thread guide is further provided with a guide portion (9). The second lever (10) is rotatably mounted to the body (2) so as to be rotatable about a third rotation axis (Z) and extends between an activating end (11) and a guide end (12), to which the guide portion (9) of the thread guide is maintained slidably in contact. The thread guide means further comprise activating means which controlledly move the first (5) and the second lever (10) so (Continued)

as to position the thread guide (6) in a plurality of operating positions with respect to the needle-bearing organ of the knitting machine.

20 Claims, 11 Drawing Sheets

(58) Field of Classification Search
USPC ..... 66/145 R
See application file for complete search history.

(56) References Cited

U.S. PATENT DOCUMENTS 1,607,098 A * 11/1926 Wladyslaw ..... D04B 15/38 248/231.71
1,608,285 A * 11/1926 Zwicky ..... D04B 15/38 66/128
2,618,951 A * 11/1952 Longtin ..... D04B 15/60 66/140 R
2,757,526 A * 8/1956 Crawford ..... D04B 15/60 66/111
3,546,899 A * 12/1970 Niestroj ..... D04B 15/38 66/149 R
3,552,149 A * 1/1971 Lonati ..... D04B 15/60 66/134
3,605,444 A * 9/1971 Lonati ..... D04B 15/58 66/133
3,707,853 A * 1/1973 Lindner ..... D04B 23/08 66/84 R
3,733,858 A * 5/1973 Gasparri ..... D04B 15/60 66/140 R
3,803,878 A * 4/1974 Lonati ..... D04B 15/60 66/134
3,822,833 A * 7/1974 Fecker ..... B65H 71/00 242/364.7
3,857,260 A * 12/1974 Zwingenberger ..... D04B 23/12 66/109
3,975,926 A * 8/1976 Tenconi ..... D04B 15/60 66/131
3,994,446 A * 11/1976 Jacobsson ..... D04B 15/482 242/365.6
4,028,911 A * 6/1977 Fecker ..... D04B 15/482 242/364.5
4,056,239 A * 11/1977 Fecker ..... D04B 15/482 242/365.6
4,141,230 A * 2/1979 Kohl ..... D04B 27/32 66/204
4,144,726 A * 3/1979 Mishcon ..... D04B 15/60 66/140 R
4,193,274 A * 3/1980 Gostelow ..... D04B 15/60 66/140 R
4,266,411 A * 5/1981 Lindner ..... D04B 23/08 66/203
4,385,507 A * 5/1983 Sawazaki ..... D04B 15/61 66/140 R
4,404,821 A * 9/1983 Johnson ..... D04B 15/60 66/139
4,437,323 A * 3/1984 Hittel ..... D04B 23/12 66/84 A
4,606,202 A * 8/1986 Del Bene ..... D04B 15/58 66/134
4,656,842 A * 4/1987 Sawazaki ..... D04B 15/60 66/139
5,046,333 A * 9/1991 Sawazaki ..... D04B 15/58 66/140 R
5,056,339 A * 10/1991 Lonati ..... D04B 15/80 66/133
5,070,709 A * 12/1991 Guell ..... D04B 15/60 66/140 R
5,186,027 A * 2/1993 Tenconi ..... D04B 15/61 66/145 R
5,237,841 A * 8/1993 Lonati ..... D04B 15/60 66/139
5,251,463 A * 10/1993 Lonati ..... D04B 15/58 66/138
5,491,987 A * 2/1996 Beconcini ..... D04B 15/58 66/130
5,524,459 A * 6/1996 Beconcini ..... D04B 15/58 66/136
5,964,106 A * 10/1999 Shibata ..... D04B 15/60 66/140 R
6,000,245 A * 12/1999 Plath ..... D04B 15/60 66/139
6,058,742 A * 5/2000 Dalmau Guell ..... D04B 15/60 66/140 R
6,109,069 A * 8/2000 Sangiacomo ..... D04B 15/58 66/133
6,158,250 A * 12/2000 Tibbals, Jr. ..... D04B 15/10 66/62
6,237,372 B1 * 5/2001 Puigventos ..... D04B 15/58 66/133
6,993,939 B2 * 2/2006 Franzke ..... D04B 21/165 66/84 A
7,836,731 B2 11/2010 Lonati et al.
7,845,196 B1 * 12/2010 Pai ..... D04B 15/61 66/133
D771,156 S * 11/2016 Lonati ..... D15/78
2005/0066692 A1 * 3/2005 Lonati ..... D04B 15/60 66/8
2005/0076681 A1 * 4/2005 Lonati ..... D04B 15/60 66/8
2006/0010924 A1 * 1/2006 Mista ..... D04B 27/06 66/116
2007/0251277 A1 * 11/2007 Lonati ..... D04B 27/24 66/207
2009/0107184 A1 * 4/2009 Lonati ..... D04B 27/24 66/205
2010/0180641 A1 * 7/2010 Lonati ..... D04B 15/80 66/139
2011/0056247 A1 * 3/2011 Traenkle ..... D04B 15/61 66/139
2016/0090671 A1 * 3/2016 Lonati ..... D04B 15/68 66/78
2016/0122914 A1 * 5/2016 Lonati ..... D04B 15/80 66/145 R
2016/0130735 A1 * 5/2016 Lonati ..... D04B 15/38 66/145 R

FOREIGN PATENT DOCUMENTS

GB 558180 A * 12/1943 ..... D04B 15/54
GB 1156304 A * 6/1969 ..... D04B 9/26
GB 1328757 A * 9/1973 ..... D04B 15/58
IT 0533086 A2 * 9/1992 ..... D04B 15/58
IT 0533088 A2 * 9/1992 ..... D04B 15/60
IT 0943714 A2 * 9/1999 ..... D04B 15/60
IT 1325183 9/2002
IT 1325202 9/2002
IT MI20010585 9/2002
WO WO-2004035895 A1 * 4/2004 ..... D04B 15/58
WO 2009033958 A1 3/2009
WO WO 2009033958 A1 * 3/2009 ..... D04B 15/58
WO WO 2014203159 A1 * 12/2014 ..... D04B 15/60
WO WO 2016116380 A1 * 7/2016 ..... D04B 15/58

* cited by examiner

DEVICE FOR FEEDING THREAD TO NEEDLES OF A KNITTING MACHINE

The present invention relates to a device for feeding thread to needles of a knitting machine. The invention further relates to a thread dispensing element for a thread guide for knitting machines, and a thread guide comprising the dispensing element.

The present invention relates to the technical sector of knitting machines for knitwear, seamless-type knitwear, hosiery and the like, in particular circular knitting machines.

In the present text, the term "knitting machine" is taken in general to mean a knitting machine, preferably circular, able to produce knitted articles and provided with a plurality of feeding points in which the thread is supplied to the needles of the machine. This knitting machine can be for example a single-bed or a double-bed type.

Devices are known for feeding thread to the needles of a knitting machine, known in the sector as thread guide devices, or thread guide groups. The devices are destined to be positioned at the needles of the knitting machine and each comprise one or more, typically a plurality, of thread feeding organs, known as thread guides, which feed the needles of the knitting machine with the threads necessary for forming the fabrics. The thread guides are arranged adjacent to the needle-bearing organ at a feeding point of the knitting machine.

Typically, at a single feeding point a plurality of thread guides are provided, singly activatable, either contemporaneously or alternatively, in such a way as to feed a plurality of threads to the needles and/or vary the thread or the threads supplied to the needles which transit by the feed point by effect of the motion of the needle-bearing organ with respect to the thread guides (in the case of circular knitting machines, by effect of the rotation of the cylinder). A single thread guide device typically comprises, for this purpose, a plurality of thread guides associated to a feed point.

In the prior art, each thread guide is typically constituted substantially by an elongate body pivoted, at an intermediate portion of the longitudinal development thereof, to a fixed body of the thread guide, and extending, with an operating end (or a thread-dispensing end), in the direction of the needles arranged in the needle-bearing organ. The thread guide is able to rotate controlledly (according to a predetermined angle of amplitude), by means of special actuators present in the device, about the fulcrum thereof so as to operate between a rest condition, in which it is distanced, with the dispensing end of the thread, from the needles of the machine to as to prevent the needles, at the infeed point, from catching the thread dispensed by the thread guide, and a working condition in which the thread guide is neared, with the thread dispensing end, to the needles so that the needles, being activated at the desired infeed point, can catch the thread and proceed with the formation of new knitted stitches.

The need to be able to carry out, at a same supply infeed of the machine, various types of fabric working, has highlighted the need to be able to position the dispensing end of the thread guide in different positions, typically more than two distinct positions. These positions require the predisposing of a specific elements which make up the thread guide and various actuators supplied for the activation thereof.

An example of a device for infeeding the thread to the needles or a knitting machine designed to satisfy this requirement is described in Italian Patent no. IT 1325202, in the name of the present Applicant. In this solution the thread guide is able to position the thread dispensing end thereof in six different operating positions.

Also known are thread dispensing elements for a thread guide for knitting machines, i.e. organs destined to be mounted on the thread guide at the terminal dispensing end of the thread and able to guide the running of the thread, in supply to a specific point, so as to pass it to the needles of the cylinder (or other needle bed of the knitting machine).

The thread dispensing element consists of a hollow tubular body, projecting at the end of the thread guide, through which the thread to be fed to the machine needles is made to pass and run.

An example of a thread dispensing element, destined to be mounted on a thread guide, is described in Italian patent no. IT 1325183, in the name of the same Applicant; in this solution, the dispensing element is mounted to the thread guide in such a way as to be rotatable about an axis arranged perpendicularly to the axial development of the dispensing element. Additionally, the dispensing element can be displaced axially with respect to the end of the thread guide on which it is mounted. Once the dispensing element has been established, it is fixed to the thread guide by means of a grub screw. The possibility of modifying the inclination and advancement of the thread dispensing element with respect to the end of the thread guide enables regulating the distance and orientation of the dispensing element with respect to the needles of the knitting machine.

The Applicant has found that the known devices for feeding thread to the needles of a knitting machine are not free of drawbacks and are improvable in various aspects, in particular with reference to the performance and the efficiency obtainable by the devices and the structural and operating complexity thereof.

A typical drawback of the known solutions is represented by the fact that it is not always possible to obtain a precise positioning of the dispensing end of the thread guide, due to the imprecisions in the movement of the thread guide and the components thereof and/or due to the vibrations to which the thread guide is subjected during the passage between the various operating conditions, for example from the rest condition to the working condition. Further, the thread guide devices of known type are characterised by a lower repeatability in the positioning of the ends of the single thread guides, which are typically positioned at different points, with respect to the needles of the knitting machine, at each respective passage between the rest condition and the operating condition.

The lower positioning precision and the poor repeatability in general lead to a reduction in the overall performances of the device; for example, the dispensing end of the thread can be further from or nearer to the needles with respect to a desired value; in general, the vibrations of the thread guides of the known devices can lead to a wrong realization of knitted stitches and/or can generate mesh defects.

A further drawback of known solutions relates to the fact that typically due to the structure of the thread guide and/or the vibrations to which it is subjected, it is necessary to make continuous and/or frequent regulations and calibrations to the device for feeding the thread, so as to correct the positioning errors of the thread guides and recalibrate the components so that they move in the desired way.

A further drawback of the known devices, encountered by the Applicant, lies in the kinematic structures typical of known thread guides (i.e. the movement patterns of the components thereof) which makes the movement poorly precise and/or makes it difficult to realize.

A further drawback of the known devices consists in the difficulty of precisely controlling and/or regulating, according to needs, the various positions that the dispensing end of the thread guide can assume; this makes the known devices poorly versatile and difficult to adapt to various knitting machines and/or different types of textile working.

A further drawback of the known devices consists in the structural complexity thereof: in fact they typically comprise a plurality of thread guides, singly activatable, movably inserted internally of a single body of the device. Because of the number of elements that make up each thread guide, as well as the position and the movement of the actuators dedicated singly to each of the thread guides, the body of the device assumes a complicated structure that is difficult to realize; this increases the production costs and makes it difficult and/or slow to mount, set and maintain. Further, considering that a single knitting machine comprises a plurality of devices for feeding the thread arranged about or along the needle-bearing organ, the setting-up of known knitting machines is more greatly susceptible to mounting errors, and the functioning is subject to faults and/or malfunctioning.

A further drawback of the known solutions consists in the poor activating velocity obtainable for the single thread guides, due to the structure and/or the kinematics of the thread guides of known type. The Applicant has further found that the thread dispensing elements of known type, present in the thread guides for knitting machines, and in general the thread guide organs for knitting machines, are not without drawbacks and are improvable in various ways.

A drawback typical of the thread dispensing elements of known type consists in the difficulty of precisely defining the position thereof with respect to the end of the thread guide on which they are mounted. This is due in particular to the need to manually rotate the dispensing element in the thread guide seating and thus fix the position with an appropriate blocking grub screw. These operations can be difficult and/or slow and typically lead to errors in the positioning of the dispensing element, which takes on an orientation and/or a distance that are wrong with respect to the needles.

A further drawback of the known dispensing elements is characterised by the instability of the fixing position assumed with respect to the thread guide on which they are mounted and/or the predisposition—during the movement of the thread guide—to vibratory phenomena. This instability is also due, and often significantly so, to the masses in motion, in particular the mass of the thread guide.

A further drawback of the known dispensing elements relates to the difficulty of realising and/or the high cost of these solutions, and/or in the predisposition to breakage and wear phenomena.

In this situation the aim at the base of the present invention, in the various aspects and/or embodiments thereof, is to provide a device for feeding thread to the needles of knitting machines which can obviate one or more of the mentioned drawbacks.

A further aim of the present invention is to provide a device for feeding thread to the needles of knitting machines characterised by a high level of precision and/or repeatability in the positioning of the dispensing end of the thread, and/or characterised by a movement of the single thread guides that is stable and not subject to vibratory phenomena.

A further aim of the present invention is to make available a device for feeding thread to the needles of knitting machines able to position the dispensing end of the thread of each thread guide selectively in a multiplicity of positions, and characterised by a high versatility of use such as to make it easily adaptable to the various types of knitting machines and/or to production needs.

A further aim of the present invention is to provide a device for feeding thread to the needles of knitting machines able to activate the respective thread guides with a greater velocity with respect to the known devices.

A further aim of the present invention is to provide a device for feeding thread to the needles of knitting machines that is able to improve the performance of a knitting machine, in particular increasing the knitting productivity of the machine, for example in terms of quantity of fabric produced per unit of time and/or complexity of the fabric produced.

A further aim of the present invention is to provide a device for feeding thread to the needles of knitting machines able to give a more efficient and effective control of the feed of thread to the needles of the machine.

A further aim of the present invention is to provide a device for feeding thread to the needles of knitting machines characterised by a simple and rational structure.

A further aim of the present invention is to provide a device for feeding thread to knitting machines characterised by a competitive overall cost and/or by a high degree of reliability of functioning and/or a high degree of ease of mounting and/or setting-up and/or maintenance.

A further aim of the present invention is to provide a device for feeding thread to the needles of knitting machines characterised by a structure and/or a functioning that are innovative.

A further aim of the present invention, in its various aspects and/or embodiments, in particular in relation to the dispensing element of the thread destined to be mounted on a thread guide, is to make available a dispensing element of the thread to the needles of knitting machines, and a thread guide comprising the element, which are able to obviate one or more of the drawbacks.

A further aim of the present invention is to provide a dispensing element of the thread that can be mounted on a respective thread guide precisely, such as to take on a determined position and a specific orientation with respect to the needles of the machine.

A further aim of the present invention is to provide a thread dispensing element mountable to a respective thread guide simply and/or rapidly and/or easily reversibly.

A further aim of the present invention is to provide a thread dispensing element characterised by a high degree of mounting stability on the respective thread guide.

A further aim of the present invention is to provide a thread dispensing element that is simple and/or economical to realise.

These aims and others besides, which will emerge more clearly during the following description, are substantially attained by a device for feeding thread to needles of a knitting machine and/or by a dispensing element of the thread for a thread guide for knitting machines and/or by a thread guide comprising the dispensing element, according to one or more of the accompanying claims, each of which taken alone (without the relative dependencies) or in any combination with the other claims, as well as according to the following aspects and/or embodiments, variously combined, including with the above-mentioned claims.

In a first aspect, the invention relates to a device for feeding thread to the needles of a knitting machine, the device comprising:

a body of the device destined to be associated to a knitting machine, at a needle-bearing organ of the knitting machine, and configured to movably house thread guide means, thread guide means, movably housed at least partially in the body and comprising a first lever, a second lever and a thread guide.

In an aspect the first lever is rotatably mounted to the body of the device such as to be able to rotate about a first rotation axis.

In an aspect the thread guide rotatably mounted to the first lever such as to be able to rotate, with respect to the first lever, about a second rotation axis, the thread guide having an elongate conformation and extending longitudinally between a rear end and a front end, the front end projecting and emerging from the body in a direction of the needle-bearing organ and defining at least a passage for a thread to be dispensed to the needles of the needle-bearing organ, the thread guide being provided with a guide portion interposed between the rear end and the front end.

In an aspect the second lever is rotatably mounted to the body of the device such as to be able to rotate about a third rotation axis, the second lever longitudinally extending between an activating end and a guide end, the guide portion of the thread guide being configured such as to stay slidably in contact with the guide end of the second lever.

In an aspect the thread guide means comprise activating means positioned at least partially in the body and configured and predisposed so as to controlledly move at least the first lever and the second lever so as to position the thread guide into a plurality of operating positions with respect to the body and with respect to the needle-bearing organ of the knitting machine.

In an aspect the activating means comprise a first actuator activatable on the first lever such as to determine a rotation thereof about the first rotation axis and with an amplitude equal to a first regulatably-variable angle between an advanced position and a retracted position, to which correspond respectively a displacement of the front end of the thread guide distancingly from the needle-bearing organ and a displacement of the front end of the thread guide nearingly to the needle-bearing organ.

In an aspect, the displacements occur in a mode and/or a trajectory defined by the conformation of the guide portion of the thread guide.

In an aspect the activating means comprise a second actuator activatable on the second lever so as to determine a rotation thereof, about the third rotation axis and with an amplitude equal to a second regulatably-variable angle, between a first position and a second position, to which correspond respectively a displacement of the front end of the thread guide in a rising direction with respect to the needle-bearing organ, up to a first vertical height, and a displacement of the front end of the thread guide in a lowering direction with respect to the needle-bearing organ, up to a second vertical height lower than the first vertical height.

In an aspect the thread guide means comprise elastic means positioned at least partially in the body and configured and predisposed to elastically oppose the movement imposed on the first lever and/or on second lever by the activating means.

In an aspect the first and second lever are not constrained to one another, i.e. they perform respective rotating movements thereof independently of one another.

In an aspect the needle-bearing organ is a needle bed; preferably the needle-bearing organ is a cylinder of a circular knitting machine.

In an aspect the first, second and third axis are parallel to one another.

In an aspect the device is destined to be mounted on the knitting machine in such a way as to be positioned adjacent to the needle-bearing organ and in proximity thereof, such that it can interact selectively with the needles of the needle-bearing organ.

In an aspect the thread guide exhibits a back at a thickness of the thread guide, the thickness developing perpendicularly to the longitudinal development of the thread guide. In an aspect the back is in an upper position in the thread guide. In an aspect the guide portion of the thread guide is defined on the back of the thread guide and comprises a portion of an upper surface of the thread guide which extends in the direction of the longitudinal development of the thread guide.

In an aspect the portion of upper surface defining the guide portion develops on planes that are substantially parallel to the second rotation axis of the thread guide with respect to the first lever.

In an aspect the back of the thread guide, in particular the portion of guide on the back of the thread guide, is maintained pressed, with a determined force, on the guide end of the second lever by means of the first elastic element, which prevents detachment, typically due to gravity, of the thread guide from the second lever.

In an aspect the guide portion of the thread guide realizes a flat cam associated to the guide end of the second lever, which functions as a yielding element associated to the flat cam. The profile of the guide portion determines the trajectory followed by the front end of the thread guide following the rotation imposed on the thread guide by the first lever and/or following the rotation imposed on the thread guide of the second lever.

In an aspect the thread guide comprises a fin emerging superiorly from the thread guide and developing over a longitudinal portion of the thread guide, parallel to the longitudinal axis of the thread guide. In an aspect the back of the thread guide is realized on the fin and/or coincides with an upper surface of the fin. In an aspect the guide portion is defined on the fin, preferably is defined on an upper surface of the fin. In an aspect the upper surface of the fin develops on planes that are substantially parallel to one or more of the first, second and third rotation axis.

In an aspect the fin is maintained pressed, with a determined force, on the guide end of the second lever, preferably by means of the first elastic element.

In an aspect the first lever and the second lever are rotatably mounted to the body at a same point, the third rotation axis coinciding with the first rotation axis, at which they intersect to form a cross configuration. In an aspect the second lever comprises, between the activating end and the guide end, a through-recess in which the first lever is inserted, the recess realizing a forked mounting of the first lever on the second lever.

In an aspect the first elastic element is constrained to the thread guide at a point of the thread guide interposed between the guide portion and the front end. In an aspect the second elastic element is constrained to the first lever at the upper end of the first lever, or at a proximal point to the upper end, or a point interposed between the central portion and the upper end of the first lever.

In an aspect the activating means comprise a third actuator acting on the second lever such as to determine a further rotation thereof, about the third rotation axis and with an amplitude equal to a third regulatable angle, between the first or second position and a third position, in which to the further rotation of the second lever so as to bring itself into the third position corresponds a displacement of the front end of the thread guide in a lowering direction with respect to the needle-bearing organ, up to a third vertical height lower than the second vertical height.

In an aspect the activating of the third actuator enables rotating the guide end of the second lever in a downwards direction, bringing it into the third position. In an aspect the passage of the second lever into the third position can occur both starting from the first position, and starting from the second position, in the first case the third actuator moving the second lever, in a lowering direction, from the first height directly to the third vertical height, while in the second case the third actuator moving the second lever—in a lowering direction—from the second height to the third vertical height.

In an aspect the thread guide means comprise a third lever rotatably mounted to the body in such a way as to be able to rotate about a fourth rotation axis, preferably parallel to the first rotation axis, the third lever comprising an activating portion, which the second actuator can act, and a thrust portion, the thrust portion being configured such as to interact with the activating end of the second lever so as to determine the rotation of the second lever about the third rotation axis between the first position and the second position.

In an aspect the second actuator is arranged in the body in such a way as to interact with the activating end of the second lever, preferably at a point that is distinct from the point on which the third actuator acts on the second lever, or it is arranged in the body such as to interact with the thrust portion of the third lever.

In an aspect the front end of the thread guide is destined to cooperate with one or more needles of the knitting machine and is provided with at least a dispensing element of the thread removably associated to the guide thread and defining the passage for a thread to be dispensed to the needles of the needle-bearing organ.

In an aspect the body is provided with at least a housing seating configured such as to at least partially movably house the thread guide means in the body. In an aspect, the first lever and/or the second lever are rotatably mounted to the body internally of the seating. In an aspect, the front end of the thread guide projects and emerges from the seating in the direction of the needle-bearing organ and the activating means are preferably positioned internally of the seating In an aspect the body comprises a plurality of the seatings, distinct from one another, each of the seatings being configured such as to movably house respective thread guide means in the body, each of the respective thread guide means comprising at least a respective thread guide and respective activating means configured so as position the respective thread guide in a plurality of operating positions with respect to the seating and with respect to the needle-bearing organ of the knitting machine.

In an aspect the invention relates to a knitting machine for knitwear, hosiery or the like, comprising a needle-bearing organ exhibiting a plurality of flanked grooves extending substantially vertically, each groove movably housing a needle mobile on command in the respective groove for the formation of fabric, and comprising a device for feeding thread to the needles according to any one of the preceding aspects and/or the claims, the needle-bearing organ being mobile with respect to the device for feeding thread along a motion trajectory.

In a further independent aspect, the invention relates to a device for feeding thread to needles of a knitting machine, the device comprising:

- a body of the device destined to be associated to a knitting machine at a needle-bearing organ of the knitting machine, and provided with at least a housing seating configured such as to movably house thread guide means in the body,
- thread guide means, movably housed at least partially in the at least a housing seating and comprising at least:
- a thread guide having an elongate conformation and extending longitudinally between a rear end and a front end, the front end projecting and emerging from the body in a direction of the needle-bearing organ and defining at least a passage for a thread to be dispensed to the needles of the needle-bearing organ;
- activating means positioned at least partially in the seating and configured and predisposed to move so as to controlledly move the thread guide into a plurality of operating positions with respect to the body and with respect to the needle-bearing organ of the knitting machine, wherein the seating is configured and predisposed, in particular is profiled, so as to guide the movement of the thread guide means, in particular for guiding the movement of the thread guide means in the movement thereof between the plurality of operating positions, and/or for guaranteeing maintenance of each operating position assumed by the thread guide during the working of the knitting machine.

In an aspect the seating defines an operating plane on which the thread guide means lie and/or are mobile in the seating, the operating plane having a substantially parallel development to the orientation of the needles of the needle-bearing organ, the longitudinal development of the seating lying on the operating plane. In an aspect the seating is singly dedicated to movably housing a single thread guide. In an aspect the operating plane of the seating is such as to be, when the device is mounted, substantially aligned to the needles of the knitting machine.

In an aspect the seating has a recess shape, or a groove shape, realised in the body of the device, and comprises two facing lateral walls, preferably parallel to one another, configured so as to slidably house the thread guide means. In an aspect, the two lateral walls are substantially identical to one another and/or each exhibit a respective lower portion, the lower portions being facing and configured so as to guide from the sides the movement of the thread guide, parallel to the walls, between the plurality of operating positions, containing it laterally internally of the seating.

In an aspect the distance between the lateral walls of the seating is substantially equal to a thickness of the thread guide, perpendicular to the longitudinal development thereof, so that the thread guide, in the movement thereof between the operating positions, in particular nearingly and distancingly with respect to the needle-bearing organ, moves substantially into contact with the lateral walls of the seating, and parallel to the walls, preventing lateral oscillations, or transversal oscillations with respect to the walls of the thread guide.

In an aspect the seating, in particular the distance between the lateral walls of the seating, is dimensioned such that the thread guide, inserted movably internally of the seating, is laterally separated from the lateral walls, in particular from at least a portion thereof, by a space or gap of at least 1 hundredth of a millimetre and/or at least 5 hundredths of a millimetre, and/or at least 1 tenth of a millimetre and/or at least 2 tenths of a millimetre and/or at least 5 tenths of a millimetre and/or at least 1 millimetre with respect to each wall.

In an aspect the seating is configured so as to guide the movement of the thread guide from inside the body, in particular along the operating plane.

In an aspect the seating is configured so as to guide movement of the thread guide from inside the body by means of a lateral containing, between the two facing lateral walls, at least of the rear end of the thread guide.

In an aspect the seating is configured so as to guide, from the sides, the movement of the thread guide without interacting with the front end thereof.

In an aspect the seating is configured so as to guide from inside the body the movement of the thread guide by means of a lateral containing, between the two facing lateral walls, of a fraction of the longitudinal extension, thereof, from the rear end, by at least 10% and/or at least 20% and/or at least 40% and/or at least 60% and/or at least 80% of the longitudinal development thereof.

In an aspect the seating is configured so as to guide from the sides the movement of the first lever, in particular at least the upper end and/or the lower end of the first lever. In an aspect the upper portions of the two walls of the seating contain and guide from the sides the upper end of the first lever, and/or the lower portions of the two walls of the seating contain and guide from the sides the lower end of the first lever.

In an aspect the seating does not guide or contain the from the sides the movement of the second lever, which is positioned at the free space of the seating.

In an aspect the guide end of the second lever comprises a respective fork configured so as to at least partially slidably house the guide portion of the thread guide, so as to guide it from the sides the motion into contact with the guide end of the second lever, and prevent lateral oscillations of the guide portion. In an aspect the fork of the guide end enables maintaining the motion of the thread guide internally of the seating and aligned with the operating plane of the seating. In an aspect, the fork of the guide end of the second lever realizes an upper guide for the thread guide, which completes the guide function carried out below the lower portions of the two lateral walls of the seating.

In an aspect the body comprises a plurality of the seatings, distinct from one another, each of the seatings being configured so as to movably house respective thread guide means in the body, each of the thread guide means comprising at least a respective thread guide and respective activating means configured to position the respective thread guide in a plurality of operating positions with respect to the seating and with respect to the needle-bearing organ of the knitting machine.

In an aspect the seatings of the plurality of seatings of the body of the device exhibit respective longitudinal developments that are parallel to one another, i.e. they define respective work planes parallel to one another and parallel to the orientation of the needles of the needle-bearing organ.

In an aspect the seatings of the plurality of seatings are configured and predisposed each to house respective thread guide means, the respective thread guides means being able to comprise a respective thread guide means of an oscillating type, i.e. mobile both vertically with respect to the needle-bearing organ and radially distancingly from and nearingly to the needle-bearing organ, or being able to comprise a respective thread guide of a non-oscillating type, i.e. mobile only vertical with respect to the needle-bearing organ.

In a further independent aspect, the invention relates to a thread dispensing element for a thread guide for knitting machines, the dispensing element comprising a body having a mounting portion, destined to be removably mounted to a front end of a thread guide, and an operating portion, destined to be facing towards the needles of a needle-bearing organ of a knitting machine, wherein the mounting portion is configured and predisposed to enable mounting the dispensing element to the thread guide according to a determined discrete number of configurations with respect to the thread guide, to which corresponds a same discrete number of positions assumed by the operating portion of the dispensing element with respect to the needles of the needle-bearing organ, the dispensing organ being configured so as to be selectively mountable to the thread guide exclusively in a configuration selected from among the determined discrete number of configurations.

In an aspect the determined discrete number of mounting configurations is exactly two in number, the mounting portion being mountable to the thread guide in a first mounting configuration, to which corresponds a low position of the operating portion, or in a second mounting configuration, to which corresponds a high position of the operating portion.

In an aspect the mounting portion is characterised by a bilateral symmetry, i.e. it is symmetrical with respect to a plane of symmetry passing through the longitudinal axis of the mounting portion.

In an aspect the longitudinal hole is open on the rear end defining a first opening and is open on the front end defining a second opening, the first opening enabling insertion of an infeed thread into the dispensing element and the second opening enabling exit, towards the needles of the knitting machine, of the infeed thread.

In an aspect the second opening is dealigned from the first opening with respect to the longitudinal axis. In an aspect the first opening is coaxial to the longitudinal axis. In an aspect, in the first mounting configuration the second opening is lower than the first opening with respect to the longitudinal axis, and in the second mounting configuration the second opening is higher than the first opening with respect to the longitudinal axis.

In an aspect the operating portion extends from the mounting portion and is dealigned with respect thereto, in particular having a respective longitudinal axis transversal to (i.e. does not coincide with) the longitudinal axis of the mounting portion.

In an aspect the mounting configuration is selected during the step of inserting the mounting portion in the mounting seating, internally of which any rotation of the dispensing element with respect to the thread guide is prevented.

In an aspect the axial position of the mounting portion internally of the seating of the thread guide can be selectively varied during the mounting step, so as to vary the distance between the operating portion and the needles of the knitting machine.

In a further aspect the invention relates to a thread guide for knitting machines provided with a front end facing towards the needles of the knitting machine, the front end having at least a mounting seating destined to removably house a dispensing element according to any one of the preceding aspects and/or the claims.

In an aspect the front end of the thread guide comprises a mounting seating complementarily shaped to the mounting portion of the dispensing element. In an aspect the mounting seating consists of a through-hole passing through the front end of the thread guide, in which the mounting portion of the dispensing element is insertable. In an aspect the thread guide comprises the dispensing element removably mounted thereto.

In an aspect the thread guide comprises blocking means arranged at the mounting seating and configured so as to removably engage with the mounting portion of the dispensing element in order to stably and removably mount it in the mounting seating.

In an aspect, the needle-bearing organ is a needle cylinder of a circular knitting machine or a needle bed of a linear knitting machine.

In an aspect the knitting machine is a knitting machine for knitwear, hosiery or the like, preferably a circular knitting machine, preferably a knitting machine of the seamless type.

Each of the above-mentioned aspects of the invention can be taken alone or in combination with any one of the claims or other aspects described.

Further characteristics and advantages will more fully emerge from the detailed description of some embodiments, among which also a preferred embodiment, given by way of non-exclusive example, of a device for feeding thread to the needles of a knitting machine according to the present invention, and a thread dispensing element for a thread guide for knitting machines according to the present invention. This description will be made in the following with reference to the accompanying figures of the drawings, supplied by way of non-limiting example, in which.

Figure 1:
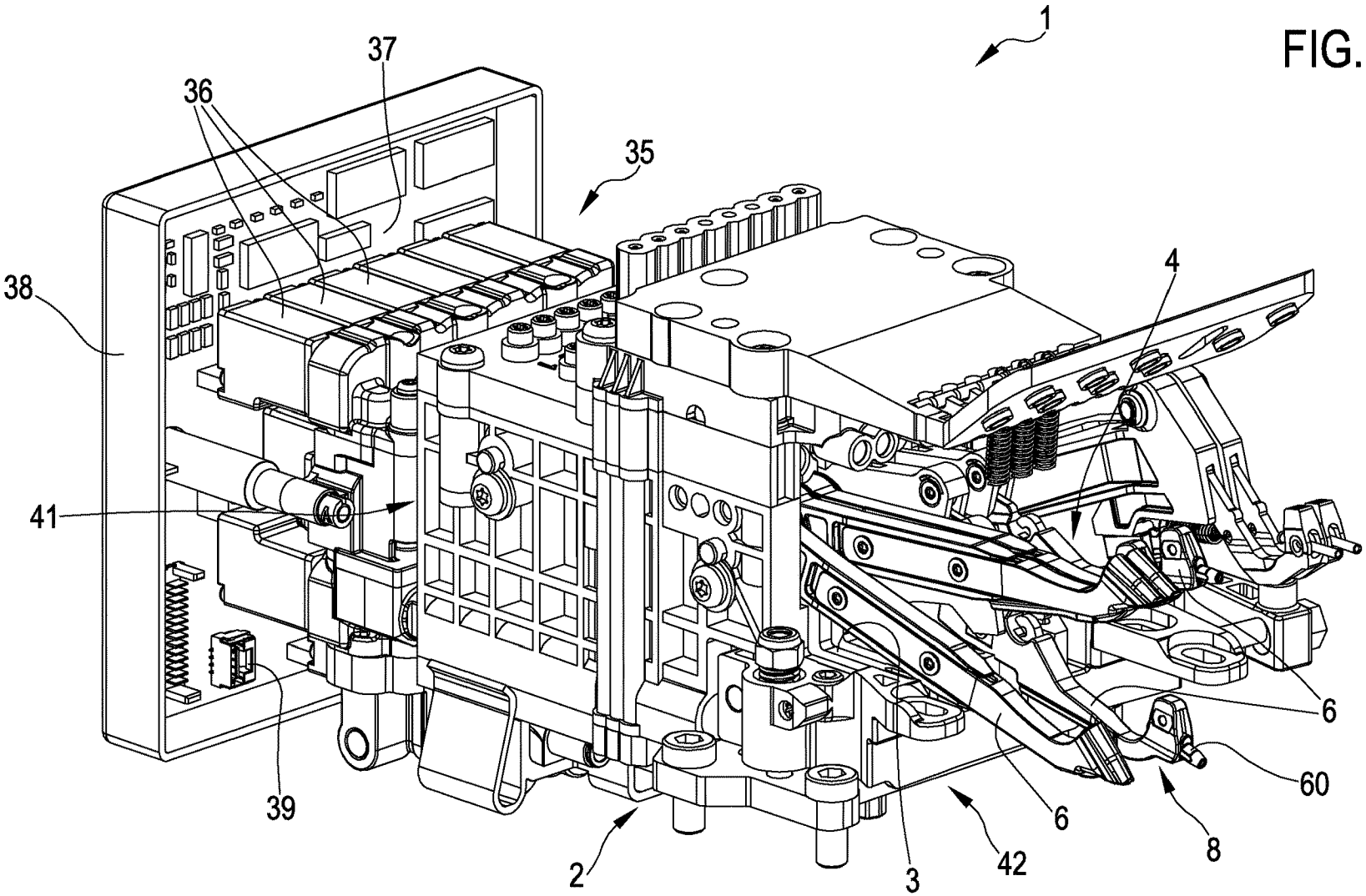
FIG. 1 is a front perspective view of a possible embodiment of a device for feeding thread to the needles of a knitting machine according to the present invention.
Figure 2:
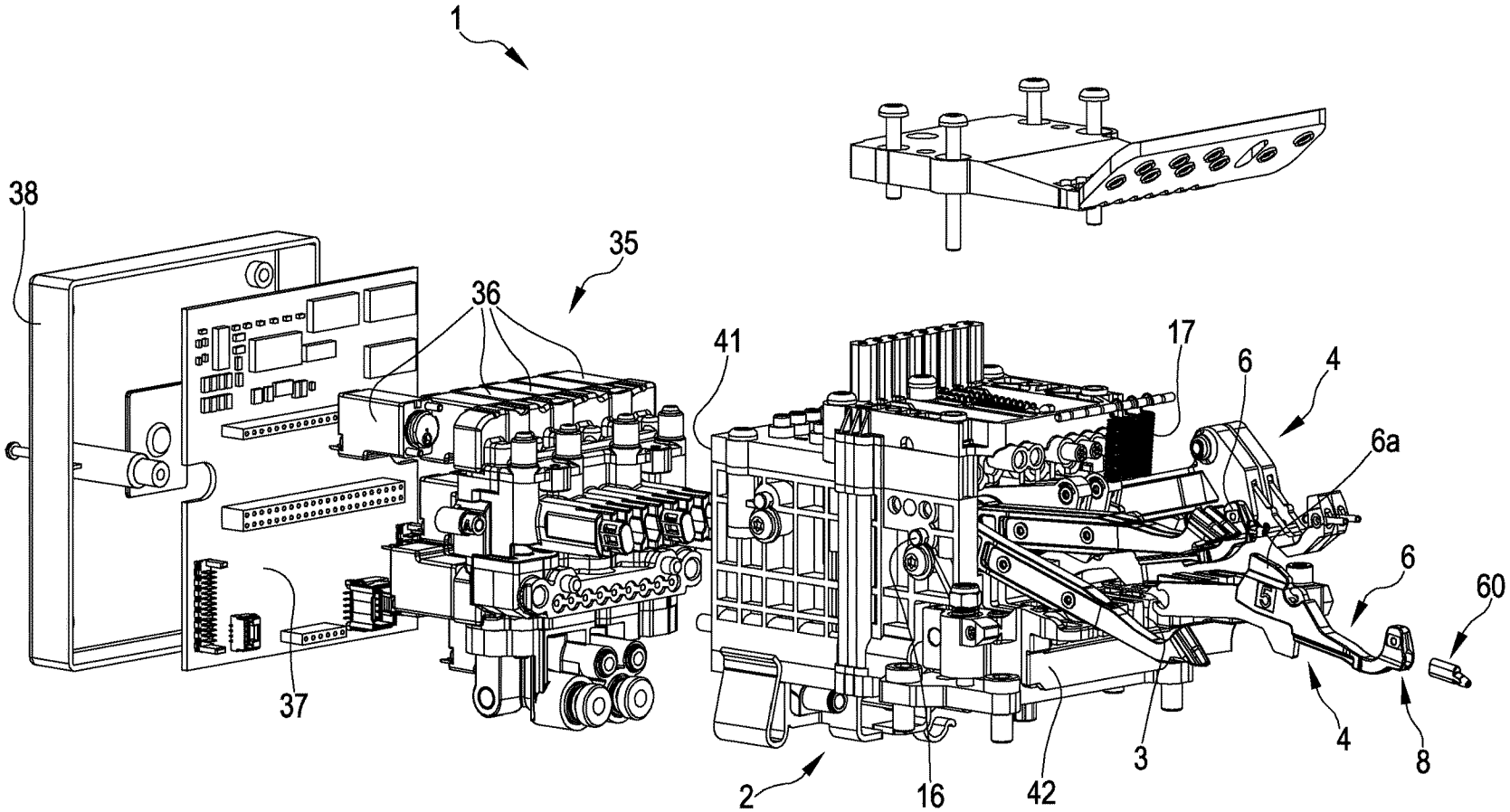
FIG. 2 is an exploded perspective view of the device of FIG. 1.
Figure 3:
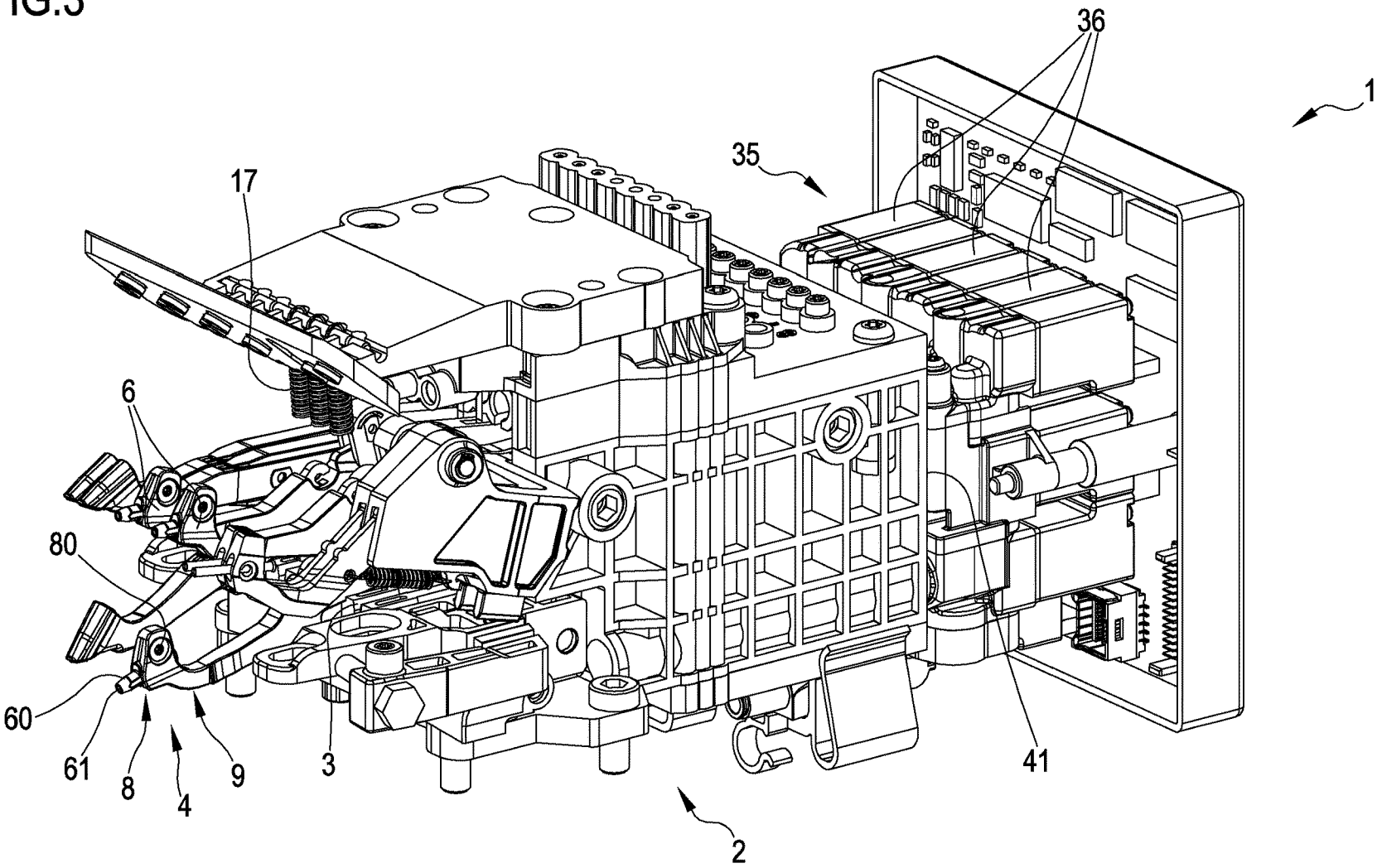
FIG. 3 is a further perspective view of the device of FIG. 1.
Figure 4:
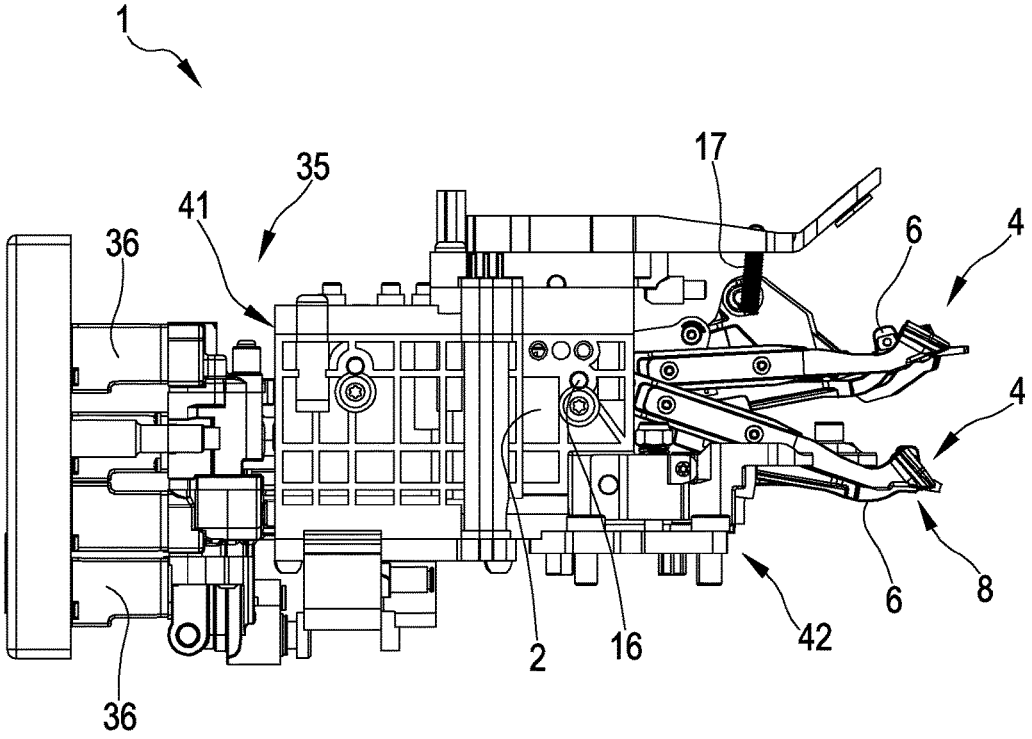
FIG. 4 is a lateral view of the device of FIG. 1.
Figure 5:
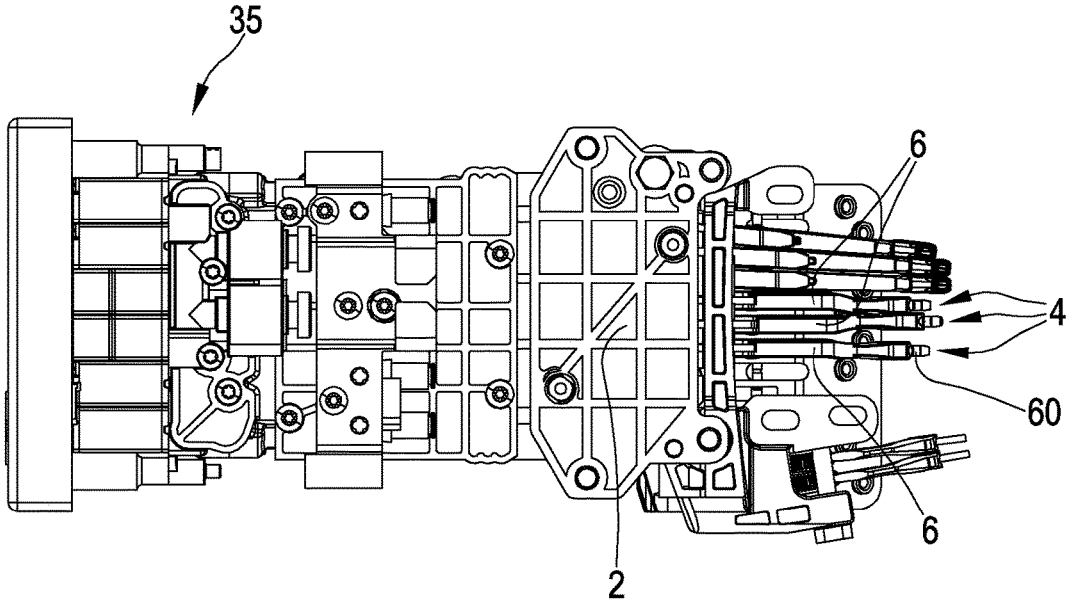
FIG. 5 is a view from below of the device of FIG. 1.
Figure 8:
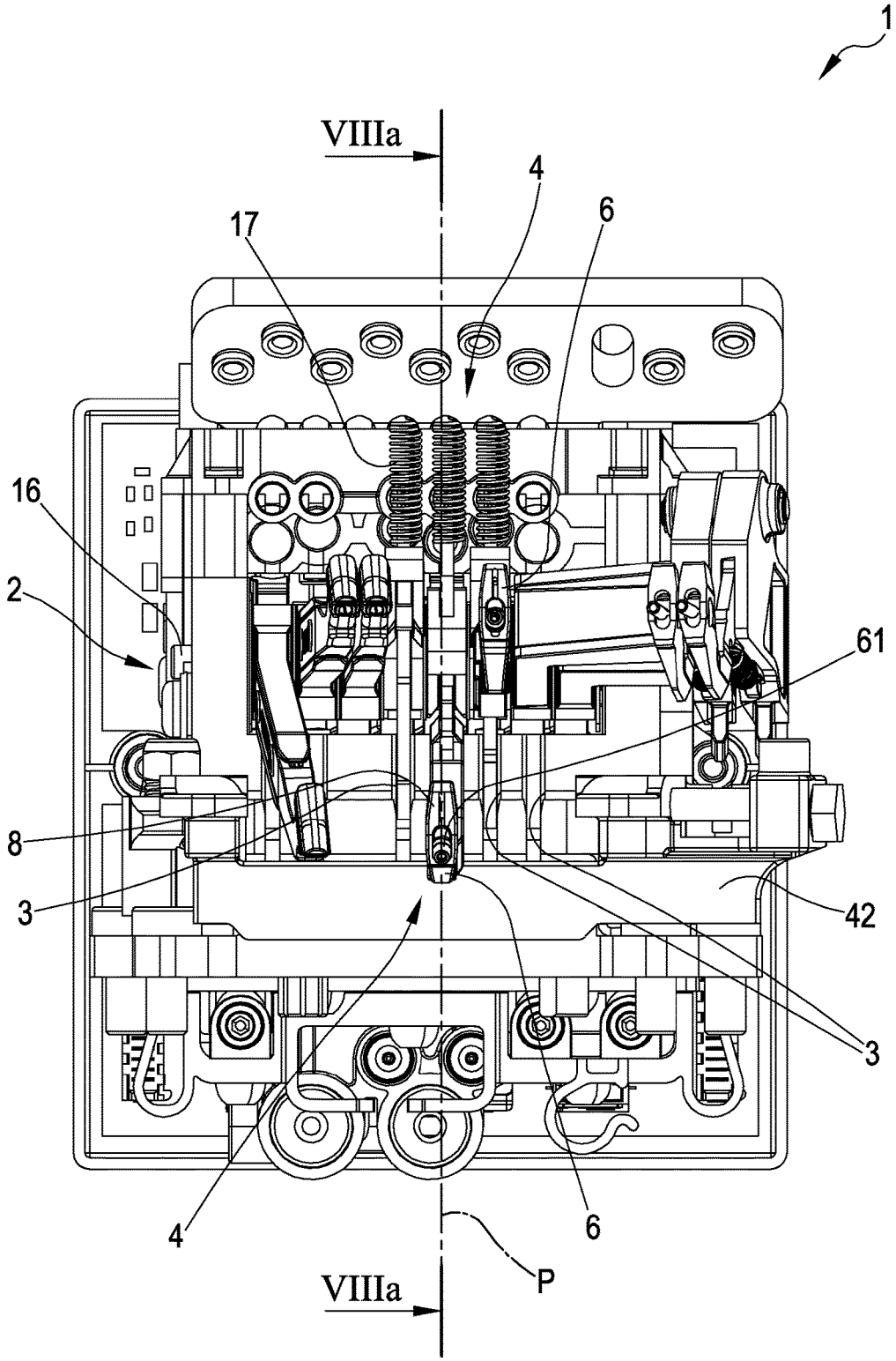
FIG. 8 is a front view of the device of FIG. 1.
Figure 8A:
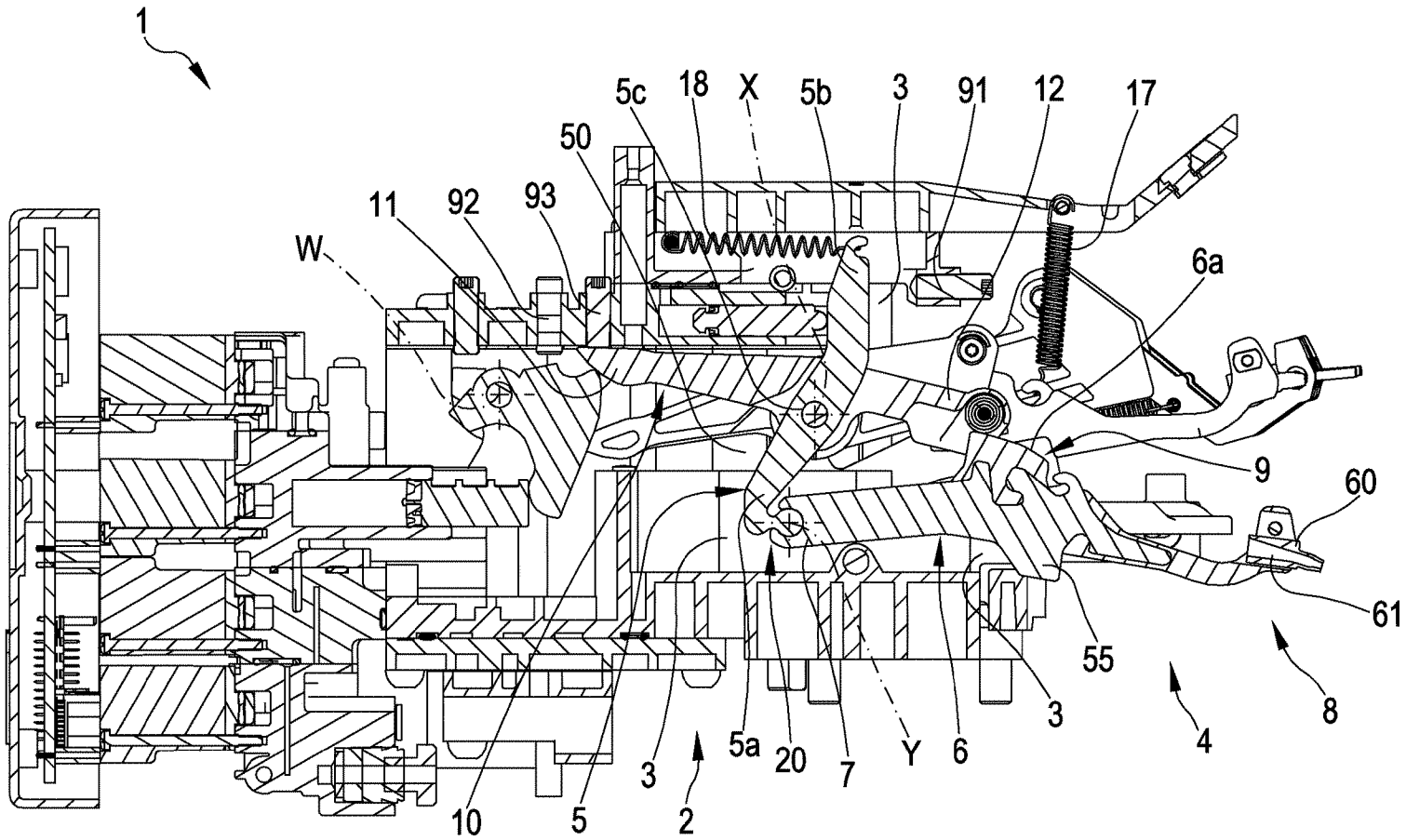
Figure 10:
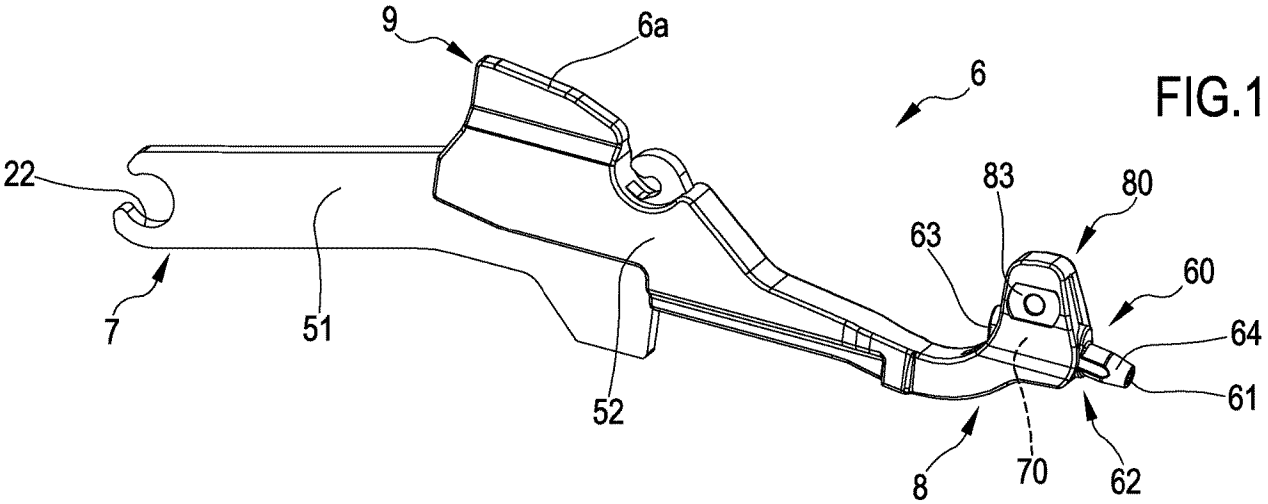
Figure 10B:
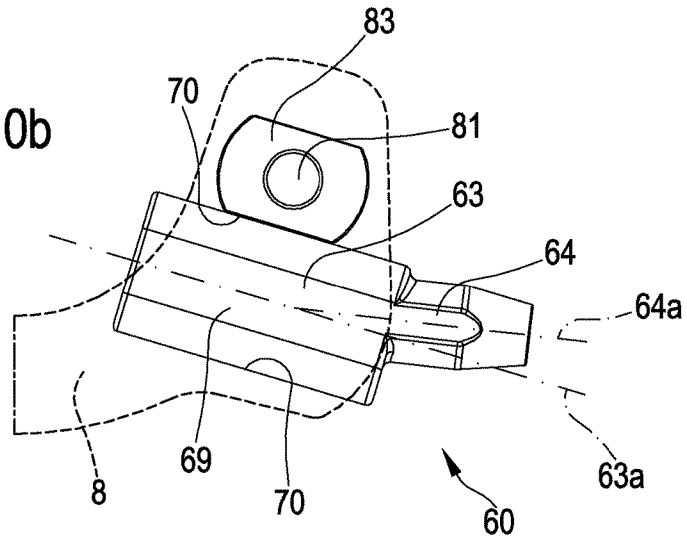
Figure 10A:
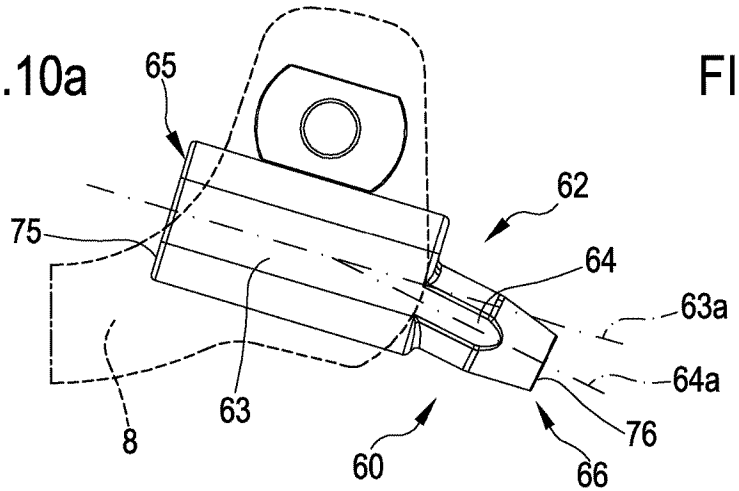
Figure 11:
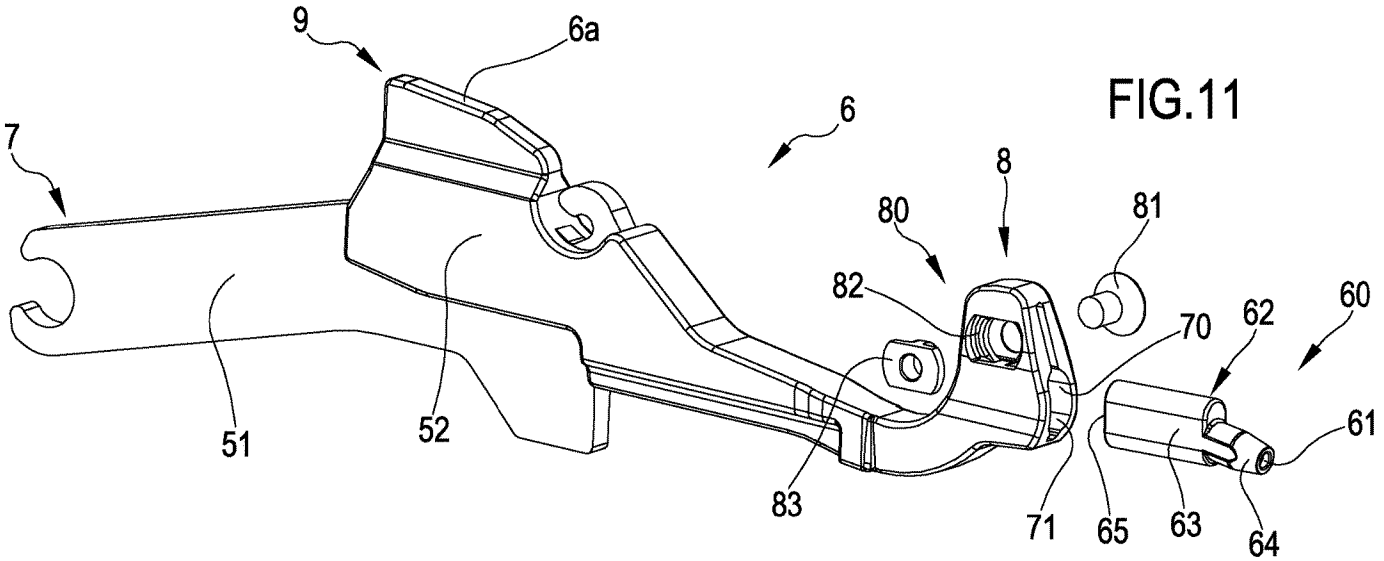
Figure 12A:
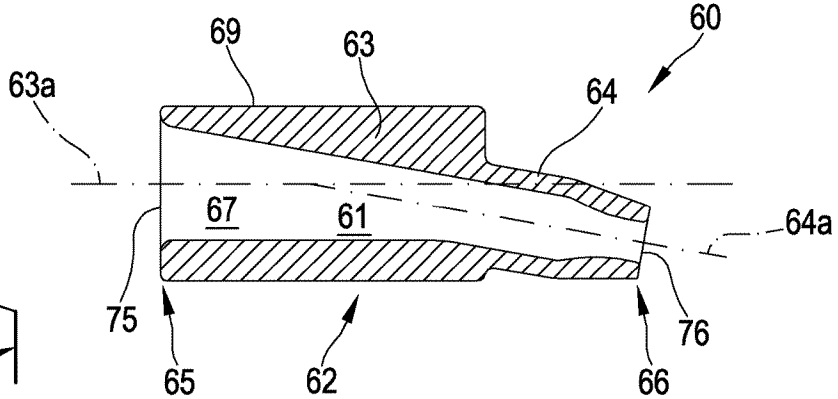
Figure 12:
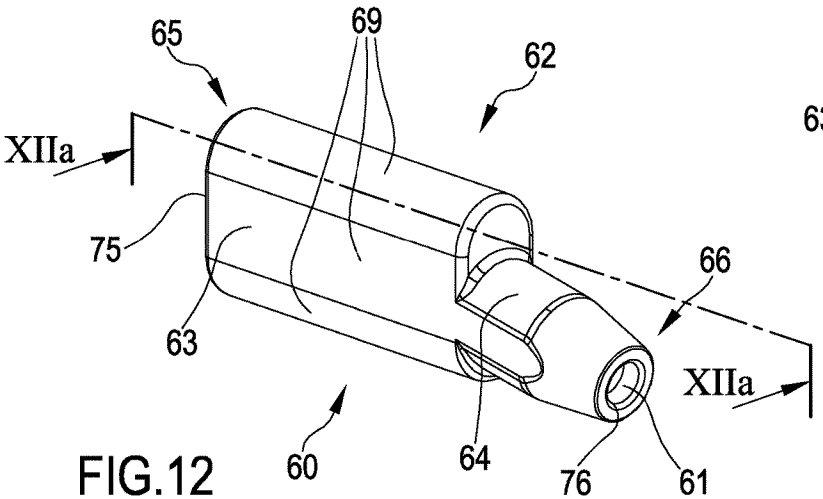

FIG. 8*a* is a section view of the device of FIG. 1, sectioned along plane VIIIa-VIIIa;

FIGS. 9*a*, 9*b*, 9*c*, 9*d*, 9*e* and 9*f* are six longitudinal-section views of the device of FIG. 1, with some parts removed, in six different operating positions, the sections being obtained by sectioning the device along plane VIIIa-VIIIa of FIG. 8;

FIG. 10 is a perspective view of a possible embodiment of a thread guide for knitting machines comprising a dispensing element of the thread according to the present invention;

FIG. 10*a* is a larger-scale view of a portion of the thread guide of FIG. 10, with some parts shown transparent and with the dispensing element of the thread in a first working configuration;

FIG. 10*b* is a further enlarged view of a portion of the thread guide of FIG. 10, with some parts transparent and with the dispensing element of the thread in a second working configuration;

FIG. 11 is a perspective exploded view of the thread guide and the dispensing element of the thread of FIG. 10;

FIG. 12 is a perspective view of a possible embodiment of a thread dispensing element according to the present invention;—FIG. 12*a* is a longitudinal section view of the thread dispensing element of FIG. 12, sectioned along plane XIIa-XIIa.

With reference to the figures, reference numeral 1 denotes in its entirety a device for feeding thread to the needles of a knitting machine according to the present invention, while numerals 60 and 6 denote respectively a thread dispensing element for a thread guide for knitting machines and a thread guide for knitting machines according to the present invention. In general, the same reference numeral is used for identical or similar elements, possible in the variant embodiments thereof.

The device of the present invention is destined to be located in any knitting machine for feeding thread to the needles of a needle-bearing organ of the machine, for the formation of fabric.

The knitting machine can be a knitting machine for knitwear, hosiery or the like, and is preferably a circular knitting machine and/or a knitting machine of the seamless type. The needle-bearing organ is preferably a needle-bearing cylinder of a circular knitting machine, but can also be a needle-bed of a linear knitting machine. The knitting machine and the relative needle-bearing organ are not shown in detail in the figures, as of known type and conventional. The present invention can be used both on new machines and on already-existing machines, in the latter case in substitution of the thread-feeding devices of traditional type. The functioning of the whole knitting machine (for example the interaction between the thread guides and the needles, the cooperation between needles and threads, etc.) is not described in detail, as it is known in the technical sector of the present invention.

The device 1 comprises a body 2 of the device associable to a knitting machine, at a needle-bearing organ of the knitting machine, and configured to movably house thread guide means 4. The thread guide means 4 are movably housed at least partially in the body 2 and comprise a first lever 5 rotatably mounted to the body 2 of the device such as to be able to rotate about a first rotation axis X. The thread guide means further comprise a thread guide 6 rotatably mounted to the first lever 5 such as to be able to rotate, with respect to the first lever, about a second rotation axis Y. The thread guide 6 has an elongate conformation and extends longitudinally between a rear end 7 and a front end 8, the front end 8 projecting and emerging from the body 2 in a direction of the needle-bearing organ and defining at least a passage 61 for a thread to be dispensed to the needles N of the needle-bearing organ. The thread guide is further provided with a guide portion 9 interposed between the rear end 7 and the front end 8.

The thread guide means further comprise a second lever 10 also rotatably mounted to the body 2 of the device such as to be able to rotate about a third rotation axis Z. The second lever longitudinally extends between an activating end 11 and a guide end 12. The guide portion 9 of the thread guide 6 is configured to stay translatably and/or slidably in contact with the guide end 12 of the second lever. In other words, the guide portion of the thread guide and the guide end of the second lever are maintained, during functioning, in contact with one another and can slide on one another. The sliding occurs on respective contact surfaces and the contact point changes instantaneously during the movement of the thread guide and the second lever. In particular, in the contact point the guide portion of the thread guide and the guide end of the second lever translate with respect to one another, while overall the contact point follows a curved trajectory determined by the rotation of the first lever with respect to the body and/or by the rotation of the thread guide with respect to the first lever and/or by the rotation of the second lever with respect to the device of the body.

The thread guide is preferably rested on or suspended from the body of the device, i.e. it is not directly constrained to the body of the device but is movably mounted thereto by means of interposing of the first lever and the second lever. In more detail, the thread guide is pivoted at a first point (preferably the rear end thereof) on the first lever, and is further maintained, in a second point (preferably the front end thereof) in contact with the second lever. The thread guide means further comprise activating means 13 positioned at least partially in the body 2 and configured and predisposed so as to controlledly move at least the first lever 5 and the second lever 10 so as to position the thread guide 6 into a plurality of operating positions (A, B, C, D, E, F, described in detail in the following) with respect to the body and with respect to the needle-bearing organ of the knitting machine.

The activating means 13 comprise a first actuator 14 acting on the first lever 5 so as to cause a rotation thereof, about the first rotation axis X and with an amplitude equal to a first regulatably-variable angle between an advanced position and a retracted position, to which correspond respectively a displacement of the front end 8 of the thread guide distancingly from the needle-bearing organ and a displacement of the front end 8 of the thread guide nearingly to the needle-bearing organ. The displacements occur in a mode and/or a trajectory defined by the conformation of the guide portion of the thread guide.

In other words, the first actuator acts on the first lever so as to impress on the thread guide a radial to and fro movement with respect to the needle-bearing organ, between a radially retracted height with respect to the needle-bearing organ and a neared height to the needle-bearing organ.

The activating means 13 preferably comprise a second actuator 15 activatable on the second lever 10 so as to determine a rotation thereof, about the third rotation axis Z and with an amplitude equal to a second regulatably-variable angle, between a first position and a second position, to which correspond respectively a displacement of the front end 8 of the thread guide 6 in a rising direction with respect to the needle-bearing organ, up to a first vertical height 101, and a displacement of the front end 8 of the thread guide 6 in a lowering direction with respect to the needle-bearing organ, up to a second vertical height 102 lower than the first vertical height.

The guide means preferably comprise elastic means positioned at least partially in the body 2 and able to elastically oppose the movement imparted on the first lever 5 and/or on second lever 10 by the activating means.

The elastic means preferably comprise a first elastic element 17 having an end constrained to the body 2 and the opposite end constrained to the thread guide 6. The first elastic element 17 is configured such as to determine a tensioning of the thread guide 6 towards the second lever 10 and to maintain the guide portion 9 of the thread guide in contact with the guide end 12 of the second lever 10.

Additionally, the first elastic element 17 preferably determines a tensioning of the thread guide 6, towards the first vertical height, such as to transmit (by means of the guide portion 9 of the thread guide in contact with the guide end 12 of the second lever), a thrust on the second lever 10 towards the first position thereof.

The first elastic element is preferably configured such as to oppose the action of at least the second actuator 15, maintaining the second lever 10 in the respective first position when the second actuator does not act on the second lever.

The elastic means preferably comprise a second elastic element 18 having an end constrained to the body 2 and the opposite end constrained to the first lever 5. The second elastic element 18 determines a tensioning of the first lever 5 towards the retracted position thereof and opposes the action of the first actuator 14, maintaining the first lever in a retracted position when the first actuator does not act on the first lever 5.

In substance, the elastic means enable an "automatic return" of the lever on which they act when the actuator acting on the lever is deactivated. In other words, the elastic means work "in opposition" with respect to the actuator acting on the lever: when the actuator is active it overcomes the elastic force of the elastic means, while when inactive the elastic force is such as to return the lever into the opposite position to the position determined by the activation of the actuator. In particular, the first elastic element is active on the thread guide, and via the thread guide on the second lever, while the second elastic element is active on the first lever, and via the first lever on the thread guide.

As shown by way of example in the figures, the first elastic element and/or the second elastic element preferably consist in a helical spring having a determined elastic coefficient, such as not to halt the movement of the lever when the actuator acting thereon is active and at the same time able to guarantee the return of the lever when the actuator is deactivated.

As can be seen in particular in FIGS. 9*a*-9*f*, the thread guide means are characterised in that the first lever 5, the second lever 10 and the thread guide 6 together realise a four-bar kinematic structure configured so as to selectively position the front end 8 of the thread guide 6 in the plurality of operating positions.

The four-bar structure is kinematically defined by a first fixed hinge, corresponding to the point in which the first lever 5 is rotatably mounted to the body 2, a second mobile hinge, corresponding to the point in which the thread guide 6 is rotatably mounted to the first lever 5, a simple constraint in the contact point between the guide portion 9 of the thread guide 6 and the guide end 12 of the second lever 10, and a third fixed hinge, corresponding to the point in which the second lever 10 is rotatably mounted to the body. Preferably (as shown by way of example in the figures) the first fixed hinge and the third hinge coincide in a single point, i.e. the first lever and the second lever are rotatably mounted to a same point of the body 2, in which case the first rotation axis X and the third rotation axis Z coincide. The first fixed hinge and the third fixed hinge are both are both kinematically connected "to earth", i.e. they enable rotation respectively of the first lever and the second lever but are fixed with respect to the body of the device (the first rotation axis X and the third rotation axis Z are fixed with respect to the body 2). From a kinematic point of view, the line joining the first fixed hinge to the third fixed hinge (which is reduced to a point if the first lever and the second lever are rotatably mounted to the body in a same point, i.e. have the respective rotation axes that coincide) represents the fixed frame of the four-bar link.

The activating means preferably comprise a third actuator 19 acting on the second lever 10 such as to determine a further rotation thereof, about the third rotation axis Z and with an amplitude equal to a third regulatable angle, between the first or second position and a third position, in which to the further rotation of the second lever so as to bring itself into the third position corresponds a displacement of the front end 8 of the thread guide in a lowering direction with respect to the needle-bearing organ, up to a third vertical height 103 lower than the second vertical height 102. In substance, the activation of the third actuator 19 enables rotating the guide end of the second lever in a downwards direction, bringing it into the third position. The passage of the second lever into the third position can occur both starting from the first position, and starting from the second position: in the first case the third actuator moves the second lever, in a lowering direction, from the first height directly to the third vertical height, while in the second case the third actuator moves the second lever—in a lowering direction—from the second height to the third vertical height. Note that the third actuator enables bringing the second lever into the third position (to which corresponds a positioning of the front end of the thread guide at the third vertical height 103) without any need to previously have activated the second actuator: in other words, the second and the third actuator act independently on the second lever, such that the second lever can be positioned as required in the first, second or third position thereof.

The first actuator 14, the second actuator 15 and/or the third actuator 19 each comprise a respective piston, preferably pneumatic (or fluid-dynamic): each piston is movable selectively at least between an inactive configuration, in which it does not interact with the respective lever or thread guide, and an active configuration, in which it is active on the respective lever or thread guide and exerts on the respective lever or thread guide a thrust having a determined entity. Each piston typically has a respective stem, which exits when the piston is activated and returns (or is maintained internally of a cylinder) when the piston is deactivated.

The body 2 is preferably provided with at least a housing seating 3 configured such as to movably house, at least partially, the thread-guide means 4 in the body 2. The first lever 5 and/or the second lever 10 are preferably rotatably mounted to the body internally of the seating 3. The front end 8 of the thread guide preferably extends and emerges from the seating in the direction of the needle-bearing organ. The activating means are preferably positioned internally of the seating.

In substance the thread guide of the present invention is characterised in that it can move, with respect to the needle-bearing organ (for example a cylinder of a circular knitting machine), both radially (nearingly and distancingly with respect to the needle-bearing organ) and vertically (rising and lowering with respect to the needles of the needle-bearing organ). This type of thread guide is known in the sector as an oscillating thread guide precisely because—beyond the traditional vertical motion—it can near and retract with respect to the needle-bearing organ.

The first actuator is the activating means which enables the radial movement of the thread guide (i.e. to bring the thread guide "out" and "into" the body of the device, i.e. respectively nearingly to or distancingly from the needle-bearing organ), while the second actuator enables a first vertical movement of the thread guide (between the first height 101 and the second height 102). Overall the presence of two actuators enables therefore defining four different operating positions for the thread guide, shown in FIGS. 9*a*-9*d*: the first position A (FIG. 9*a*) corresponds to the retracted thread guide at the first height, and the second position B (FIG. 9*b*) corresponds to the advanced thread guide at the first height, the third position C (FIG. 9*c*) corresponds to the retracted thread guide at the second height, the fourth position D (FIG. 9*d*) corresponds to the thread guide advanced and at the second height.

The addition of the third actuator 19, also active (like the second actuator 15) on the second lever 10, enables introducing a further lowering of the thread guide from the second 102 to the third height 103. The third actuator, in combination with the first actuator 14, introduces two further operating positions for the thread guide, shown in FIGS. 9*e*-9*f*: The fifth position E (FIG. 9*e*) corresponds to the thread guide retracted and at the third height, the sixth position (FIG. 9*f*) corresponds to the thread guide advanced and at the third height.

In substance, the first actuator—managing the radial movement—enables passage of the thread guide between the positions A and B, between the positions C and D and between the positions E and F; the second actuator—managing a first vertical movement—enables the passage of the thread guide between the positions A and C and between the positions B and D; the third actuator—managing a further vertical movement—enables passage of the thread guide between the positions C (or A) and E and between the positions D (or B) and F. By means of three different independent actuators six distinct operating positions can be obtained.

In the following a more detailed analysis is made of the operating positions.

The first operating position is obtained by activation of the first actuator 14 and deactivation of the second actuator 15 (and the third actuator, if present): in this position the front end 8 of the thread guide is positioned in a first point (A) in which the thread guide is prepared for lowering towards the second vertical height and the third vertical height 103.

The second operating position is obtained by deactivation of the first 14 and the second actuator 15: in this position the front end of the thread guide is positioned in a second point (B) in which either the possibility of an uptake of the thread by the needles (N) of the knitting machine is excluded, or the thread, previously dispensed to the needles of the machine, is brought posteriorly of the needle head, so as to enable interruption of the feed to the needles.

The third operating position is obtained by activation of the first 14 and the second actuator 15 (and deactivation of the third actuator, if present): in which the front end of the thread guide is positioned in a third point (C) in which all the needles (N) of the knitting machine can take up the thread, which are brought into the working process at the desired infeed.

The fourth operating position is obtained by deactivation of the first actuator 14 and activation of the second actuator 15 (and deactivator of the third actuator, if present), in this position the front end of the thread guide is positioned in a fourth point (D) in which uptake is enabled only for the needles (N) of the knitting machine which are raised more than other needles, which other needles are raised less and therefore do not take up the thread.

The fifth operating position is obtained by activation of the first 14 and the third actuator 19, and preferably deactivation of the second actuator 15, in which the front end of the thread guide is positioned in a fifth point (E) in which thread take-up is enabled for all the needles (N) of the knitting machine, which needles (N) are brought into working condition at the desired infeed.

The sixth operating position is obtained by deactivation of the first actuator 14 and activation of the third actuator 19, and preferably deactivation of the second actuator 15, in which the front end of the thread guide is positioned in a sixth point (F) in which take-up of the thread is enabled only for the needles (N) of the knitting machine which are raised less, while thread take-up is disabled for the needles (N) which are raised more, as the infed thread is positioned lower than the tongue of the latter needles.

The activation of the third actuator, so as to work between positions E and F, preferably does not require the contemporary activation also of the second actuator. They work on distinct portions of the second lever, and each of them imparts on the lever the respective rotation independently and for an angle that is sufficient to attain the respective vertical height.

From a kinematic point of view, the actuators impart particular rotary movement on the first and second lever, which transmit the motion in a controlled way to the thread guide, which is thus subjected to roto-translations which position it in the above-mentioned operating positions A-F. The movement of the levers and the thread guide can be understood from the sequence of FIGS. 9*a*-9*f* and is described in the following.

The activation of the first actuator preferably determines the rotation forwards of the upper end of the first lever and the consequent rotation backwards of the lower end, determining a retracting of the front end of the thread guide with respect to the needles of the needle-bearing organ of the knitting machine.

The deactivation of the first actuator preferably determines the rotation backwards of the upper end of the first lever and the consequent forwards rotation of the lower end, determining an advancing of the front end of the thread guide towards the needles of the needle-bearing organ of the knitting machine.

The deactivation of the second actuator preferably determines the rotation downwards of the activating end of the second lever, or the backwards rotation of the third lever acting on the activating end of the second lever, and the consequent upwards rotation of the guide end of the second lever, determining a raising of the front end of the thread guide with respect to the needles of the needle-bearing organ of the knitting machine.

The activation of the second actuator preferably determines the rotating upwards of the activating end of the second lever, or the rotation forwards of the third lever acting on the activating end of the second lever, and the consequent downward rotation of the guide end of the second lever, determining a lowering of the front end of the thread guide with respect to the needles of the needle-bearing organ of the knitting machine, from the first vertical height to the second vertical height. The deactivation of the third actuator preferably does not influence the position assumed by the second lever, which remains with the guide end thereof raised or lowered respectively with the second actuator deactivated or activated.

The activation of the third actuator preferably determines the rotation upwards of the activating end of the second lever and a consequent further rotation downwards (with respect to the rotation downwards imparted by the second actuator) of the guide end of the second lever, determining a further lowering of the front end of the thread guide with respect to the needles of the needle-bearing organ of the knitting machine, from the first to the second vertical height up to the third vertical height.

In substance, the activation of the third actuator determines a rotation upwards of the activating end of the second lever greater than the respective upwards rotation imparted by the second actuator, and thus a rotation downwards of the guide end of the second lever greater than the respective rotation downwards imparted by the second actuator, thus determining a further lowering of the front end of the thread guide with respect to the needles of the needle-bearing organ of the knitting machine, beyond the second height and into the third vertical height.

On the basis of the configuration of the activating means and the elastic means, the correlation between the state of the actuators and the position of the thread guide can be summarised in the following table:

| | First actuator | Second actuator | Third actuator |
|---|---|---|---|
| Position A | Active | Inactive | Inactive |
| Position B | Inactive | Inactive | Inactive |
| Position C | Active | Active | Inactive |
| Position D | Inactive | Active | Inactive |
| Position E | Active | Inactive | Active |
| Position F | Inactive | Inactive | Active |

The three actuators are commanded and operate independently of one another: this means that it is possible to move the front end of the thread guide as desired both among the three vertical heights 101, 102 and 103, and nearingly to or distancingly from the needle-bearing organ: in other words, the six positions A, B, C, D, E and F can be selected and reached by passing as desired between one another, by selecting the correct combination of activation/deactivation of the actuators. This without the need for the passage between "distant" points, i.e. having different vertical or radial heights to require a transit through "intermediate" points, for example having intermediate vertical heights or neared or distanced heights with respect to the needle-bearing organ.

In particular, it is possible to pass among the three vertical heights 101 and 103 without any need for activating or deactivating the second actuator (but acting directly with the third actuator), and the radial movement between points A, C, E and points B, D and F can be selected regardless of the start point and the end point (by acting directly on the first actuator).

Note that the thread guide means of the present invention are configured, preferably, in such a way that when the three actuators are all deactivated, the thread guide is automatically brought, by effect of the elastic means, into position B. This is advantageous, as position B is the normal working position of the thread guides, maintained more frequently than the other positions during the functioning of the machine. In this way, the position does not require any energetic effort (there being no actuators activated), and thus reduces the wear on the actuators and limits the stresses on the structure of the device.

As in the embodiment shown in the figures, the activating means are preferably active only on the first lever and the second lever, and do not interact directly with the thread guide.

The first rotation axis X is preferably orientated substantially parallel to the tangent to the motion trajectory of the needle-bearing organ relatively to the body 2. For example in the case of the needle-bearing organ being a cylinder, it rotates about a vertical axis and the needles thereof move with a tangential velocity that is substantially horizontal; the rotation axis X—with the device mounted—is also horizontal.

The second rotation axis Y (between the first lever and the thread guide) is preferably substantially parallel to the first rotation axis and distinct therefrom.

The third rotation axis Z preferably coincides with the first rotation axis X, i.e. the first lever 5 and the second lever 10 are pivoted to a same point of the body.

The body preferably comprises a pin 16 arranged transversally to a longitudinal development of the body, the first lever and/or the second lever being rotatably pivoted to the pin. The pin 16 preferably develops along an axis, substantially horizontal, coinciding with the first rotation axis X and/or with the third rotation axis Z. In substance the pin 16 constitutes the fixed element of the body to which the levers of the thread guide means are independently constrainable so that each of them can rotate with respect to the rotation axis thereof. The pin enables rotation of the levers pivoted thereto and prevents any translation of the levers. On the contrary the thread guide is associated to the first and the second lever such as to be able to perform roto-translations, but preferably it is not constrained to the body of the device.

The first lever 5 and the second lever 10 are preferably not constrained to one another (though pivoted to the same point of the body or to a same fixed pin of the body), i.e. they perform the relative rotary movements independently of one another.

The thread guide 6 is preferably rotatably hinged to the first lever 5 at the rear end 7 of the thread guide 6 itself. The first lever 5 preferably extends longitudinally between a lower end 5*a* and an upper end 5*b* and comprises a central portion 5*c*, intermediate between the lower end and the upper end, at which it is mounted to the body (or to the pin of the body).

The thread guide 6, in particular the rear end 7 thereof, is preferably rotatably hinged to the lower end 5*a* of the first lever 5.

The thread guide 6 and the first lever 5, in particular the rear end 7 of the thread guide and the lower end 5*a* of the first lever, preferably realize a cylindrical joint 20 which enables relative rotation between the thread guide and the first lever at least about the second rotation axis Y. The joint 20 represents the above-mentioned second mobile chain of the four-bar linkage realized by levers and thread guide.

The cylindrical joint 20 preferably comprises a protrusion 21 having a conformation, in a perpendicular section to the second axis Y, at least partially circular, and comprises a recess 22 complementarily-shaped to the protrusion 21 and configured such as to house the protrusion so as to enable rotation thereof internally of the recess. The protrusion 21 preferably emerges from the first lever and the recess is fashioned in the thread guide, or alternatively the recess is fashioned in the first lever. The protrusion 21 is preferably solidly constrained to or in a single piece with the first lever (or respectively with the recess 22 if the protrusion and the recess are inverted). In an embodiment that is not illustrated, the joint can enable a relative rotation between the thread guide and the first lever also according to axes that are different to the second rotation axis and rotated by an angle comprised between 0° and 20° with respect to the second rotation axis. In this case the cylindrical joint becomes a ball joint (or partially spherical).

The first lever and/or the second lever and/or the thread guide preferably have a substantially plate-shaped configuration. The thread guide 6 preferably exhibits a prevalent longitudinal direction, from the rear end 7 to the front end 8, and is arranged vertically internally of the seating (or in general of the body) of the device (i.e. parallel to the needs of the needle-bearing organ).

The thread guide preferably exhibits a back 6*a* at a thickness of the thread guide, the thickness developing perpendicularly to the longitudinal development of the thread guide. The back is preferably in an upper position in the thread guide. The guide portion 9 of the thread guide is preferably defined on the back of the thread guide and comprises a portion of an upper surface of the thread guide which extends in the direction of the longitudinal development of the thread guide. The portion of upper surface defining the guide portion preferably develops on planes that are substantially parallel to the second rotation axis of the thread guide with respect to the first lever. The guide end 12 of the second lever 10 preferably comprises a bearing 23 or roller configured such as to enable and/or facilitate sliding of the guide portion 9 of the thread guide with respect to the guide end 12 of the second lever.

The guide portion 9 on the back 6*a* of the thread guide is preferably maintained pressed, with a determined force, on the guide end 12 of the second lever 10 by means of the first elastic element 17, which prevents detachment of the thread guide from the second lever. This detachment would normally occur by force of gravity (because of how the thread guide and the levers are positioned). The guide portion 9 of the thread guide 6 preferably realizes a flat cam associated to the guide end 12 of the second lever 10; the guide end has the function of feeding the flat cam. The profile of the guide portion determines the trajectory followed by the front end of the thread guide following the rotation imparted on the thread guide by the first lever and/or following the rotation imparted on the thread guide of the second lever. The guide portion thus-shaped enables obtaining a radial movement of the thread guide (nearingly to or distancingly from the needle-bearing organ) substantially straight and perpendicular to the orientation of the needles. In the absence of this guide portion, which cooperates with the end of the guide of the second lever, the thread guide would perform curved movements by effect of the thrust received from the first and second lever, determined by the geometry of the rotation axes between the levers and the thread guide. Consequently the movement of the guide thread and the positioning of the operating positions A-F would be imprecise and/or subject to vibration.

In an alternative embodiment, the thread guide comprises a fin emerging superiorly from the thread guide and developing over a longitudinal portion of the thread guide, parallel to the longitudinal axis of the thread guide (see for example FIGS. 10 and 11). The back of the thread guide is preferably defined on the fin and/or coincides with an upper surface of the fin. The guide portion is preferably defined on the fin, and more preferably is defined on an upper surface of the fin. The upper surface of the fin preferably develops on planes that are substantially parallel to one or more of the first, second and third rotation axis.

With the device mounted, the fin is maintained pressed superiorly, with a determined force, on the end of the guide of the second lever, preferably by means of the elastic element.

In a possible embodiment, the second lever 10 comprises, between the activating element 11 and the guide element 12, a through-recess in which the first lever 5 is inserted, the recess realizing a forked mounting of the first lever on the second lever. The forked mounting is advantageous in particular with the first axis X and the third axis Z coinciding (as shown in the case in the figures). The first actuator 14 is preferably arranged in the seating (or in general in the body) in such a way as to interact with the upper end 5*b* of the first lever 5, or with a point proximal to the upper end, or in general with a point interposed between the central portion 5*c* (where the first lever is pivoted) and the upper end 5*b* of the first lever. In this way, to a clockwise rotation of the upper end of the first lever corresponds a rotation in an anticlockwise direction of the lower end, and vice versa.

The second actuator 15 is preferably arranged in the seating (or in general of the body) in such a way as to interact with the activating end 11 of the second lever 10, or with a point proximal to the activating end, or again with a point interposed between a central portion, at which the second lever is mounted to the body, and the activating end 11. In this way, to a rotation in a clockwise direction of the activating end of the second lever corresponds a rotation in an anticlockwise direction of the guide end, and vice versa. Note that the second lever, described in the present invention, is pivoted to the centre and has the guide end advanced towards the needle-bearing organ and in contact with the thread guide: this configuration enables having a rest and a guide for the oscillating thread guide during each movement.

The first elastic element 17 is preferably constrained to the thread guide 6 at a point of the thread guide interposed between the guide portion 9 and the front end 8. At this point the thread guide can exhibit, for example, an attaching hook of the first elastic element.

The second elastic element 18 is preferably constrained to the first lever 5 at the upper end 5*b* of the first lever, or a point proximal to the upper end, or at a point interposed between the central portion 5*c* and the upper end of the first lever.

In a first possible embodiment, as shown by way of example in the figures, the thread guide means 4 can further comprise a third lever 30 rotatably mounted to the body of the device such as to be able to rotate about a fourth rotation axis W, preferably parallel to the first rotation axis. The third lever comprises an activating portion 31 and a thrust portion 32, where the thrust portion interacts with the activating end of the second lever 10 so as to determine the rotation of the second lever about the third rotation axis between the first position and the second position.

The second actuator 15 is preferably arranged in the body (or the seating) in such a way as to interact with the activating end 31 of the second lever, preferably (as in the figures) in a point distinct from the one on which the third actuator 19 acts on the second lever 10, or it is arranged in the body in such a way as to interact with the thrust portion of the third lever.

Observe that the third level is optional: it is possible to active both with the second actuator and the third actuator directly on the second lever 10, for example in two distinct points of the activating end 11 of the second lever or on other portions thereof.

The thread guide means 4 preferably comprise a first end-run stop 91 housed in the body (or the seating) and able to halt the rotation of the first lever 5 determined by the activation of the first actuator 14. The first end-run stop thus defines the amplitude of the rotation in the clockwise direction of the first lever. The first end-run stop can be an adjustable grub screw, so as to select the angular amount on the rotation of the first lever.

The thread guide means 4 preferably comprise a second end-run stop 92 housed in the body (or the seating) and able to halt the rotation of the second lever 10, or the rotation of the third lever acting on the activating end of the second lever, determined by the activation of the second actuator 15. In the figures the third lever is present, on which the second actuator acts, so the second end-run stop is positioned so as to halt the rotation of the third lever; alternatively, the second end-run stop might directly halt the activating end of the second lever, should the thread guide include only four operating positions (A, B, C, D). The second end-run stop thus defines the amplitude of the rotation in the clockwise direction of the second lever between the first and the second position. The second end-run stop 92 can be an adjustable grub screw, so as to select the angular amplitude of the first rotation of the second lever.

The thread guide means 4 preferably comprise a third end-run stop 93 housed in the body (or in the seating) and able to halt the further rotation of the second lever 10 determined by the activation of the third actuator 19. The third end-run stop thus defines the amplitude of the further clockwise rotation of the second lever between the second and the third position thereof. The third end-run stop 93 can be an adjustable grub screw, such as to select the angular amplitude of the further rotation of the second lever.

The regulating of the first and/or second and/or third end-run stop enables precisely defining points A-F attained by the front end 8 of the thread guide, with particular reference to the respective first height 101, second height 102 and third height 103 associated to each point.

The thread guide 6 (see in particular FIGS. 9*a*-9*f*) preferably comprises a foot 55 destined to cooperate with a stop 57 of the device for halting a radial advancement of the thread guide, nearingly to the needle-bearing organ, in the motion thereof towards the fourth position D, and/or towards the sixth position F, in this way defining the respective radial distance of the front end 8 from the needle-bearing organ in the fourth position D and/or sixth position F. The foot 55 is positioned preferably inferiorly of the thread guide and in an intermediate position between the rear end and the front end, for example below the guide portion 9 of the thread guide.

The foot 55 of the thread guide 6 can comprise a front surface 56, destined to enter into contact with the stop 57 and to cause halting of the radial motion of the thread guide towards the needle-bearing organ. The front surface of the foot is preferably shaped or profiled in such a way that when the foot 55 is in contact with the stop 57, a vertical movement of the thread guide determines a thrust by the stop on the front surface of the foot, the thrust causing a radial displacement of the foot and the whole thread guide according to a trajectory which is a function of the shaping or profiling of the front surface of the foot.

In other words, the front surface 56 of the foot 55 realises a cam profile cooperating with the stop 57, and a vertical motion of the thread guide foot on the stop determines a radial movement of the whole thread guide with respect to the stop and a consequent radial retraction or advancement of the front end of the thread guide with respect to the needle-bearing organ.

The presence of the foot 55 of the thread guide, and the specific profiling thereof, enable performing an automatic retraction of the thread guide during determined movements thereof. In particular, consider that when the thread guide is in the sixth position F and is moved towards the operating position, the front end of the thread guide can interfere with one or more needles of the knitting machine, due to the vertical raising of the thread guide. The foot of the thread guide, with the profiling thereof, advantageously enables introducing an automatic radial retraction of the thread guide during the rising thereof, which enables slightly displacing the thread guide distancingly from the needle-bearing organ (retracting into the seating of the body of the device), enabling impacts or interference with the needles to be avoided.

The stop 57 is associated to the body anteriorly of the seating housing the thread guide in an intermediate position between the seating and the needle-bearing organ. The stop can be a separate element associable to the body of the device or can be realized in a single piece therewith. In any case the stop, if present, constitutes a part of the body of the device or the seating housing the thread guide.

Figure 9A:
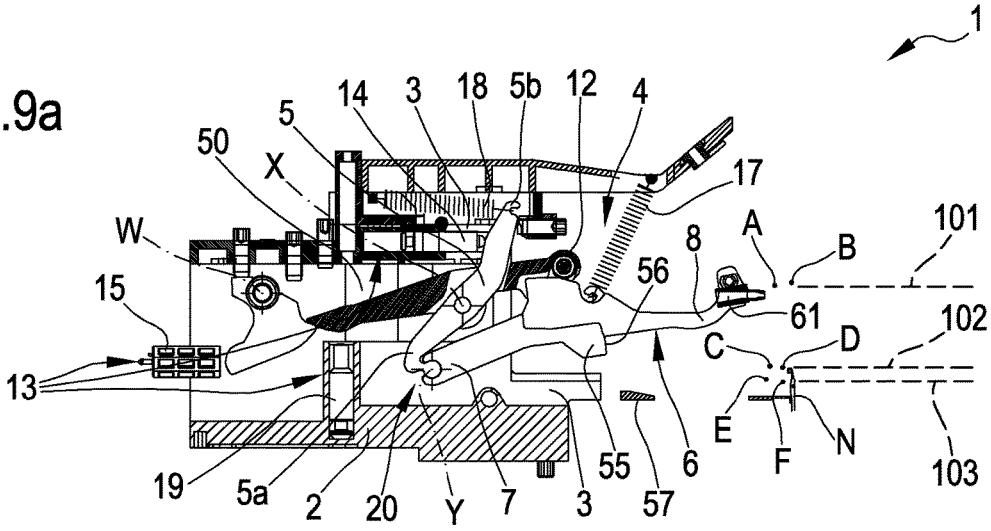
Figure 9B:
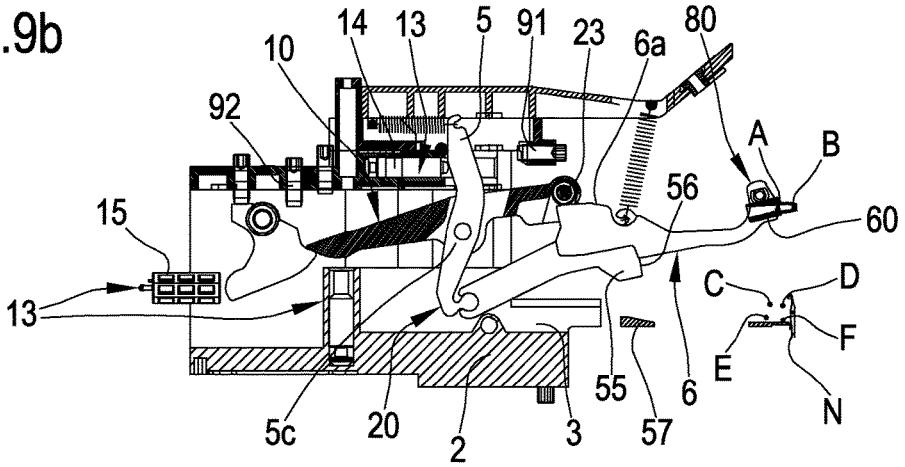
Figure 9C:
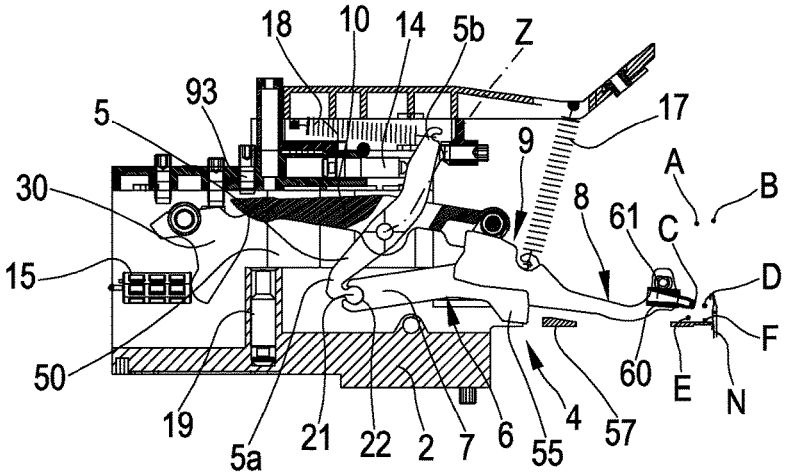
Figure 9D:
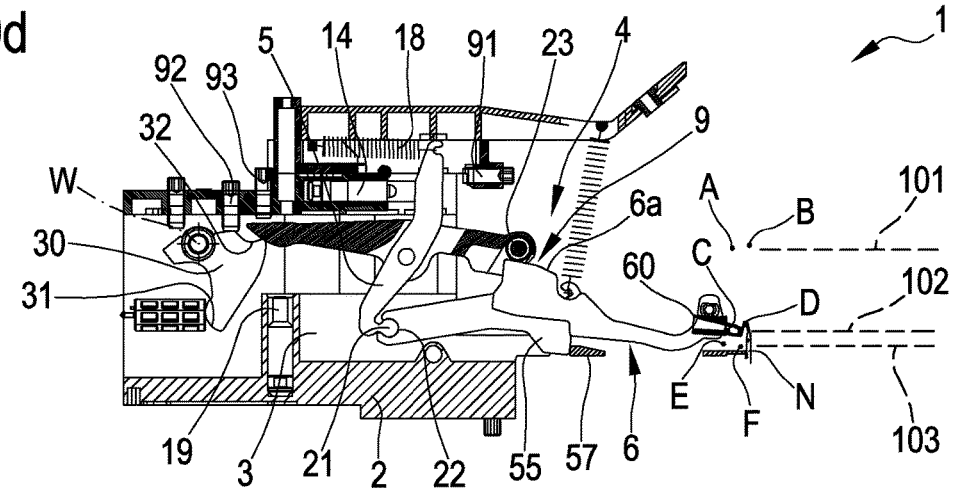
Figure 9E:
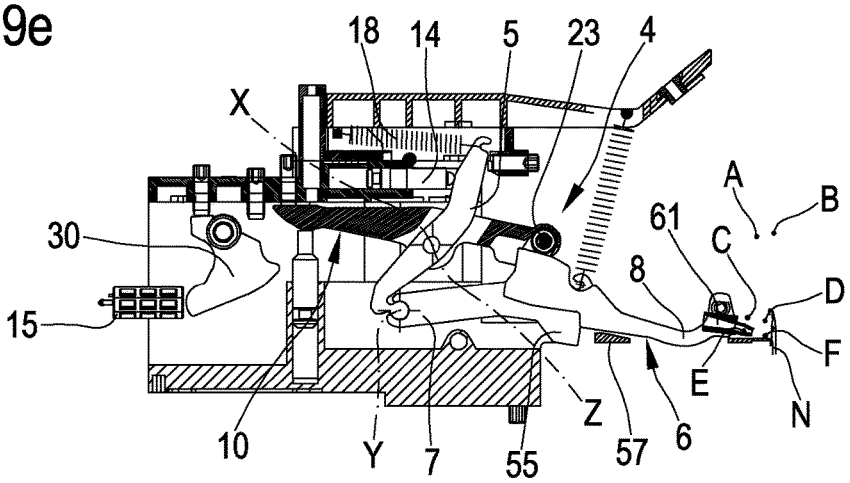
Figure 9F:
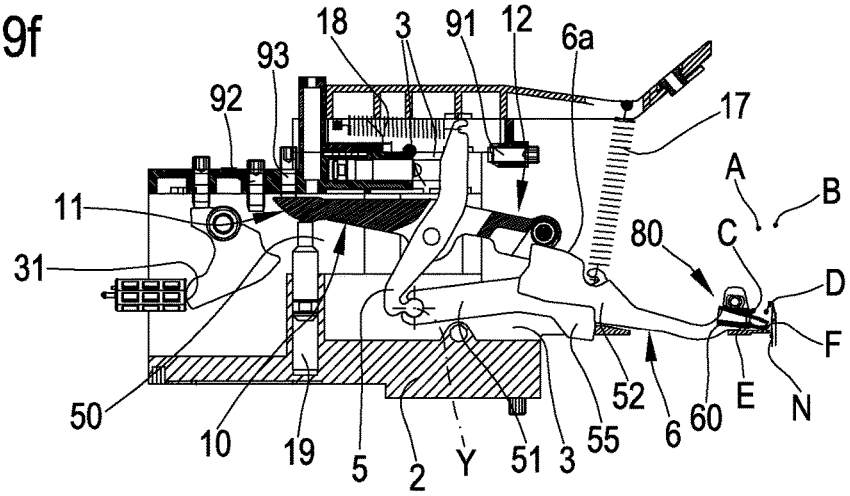

In FIGS. 9*d* and 9*f* it is possible to observe the cooperation between the foot 55 of the thread guide and the stop 57 of the body of the device, respectively with the thread guide in the fourth position D and in the sixth position F.

As described above, the front end 8 of the thread guide 6 is destined to cooperate with one or more needles of the knitting machine and is provided with at least a dispensing element 60 of the thread removably associated to the thread guide and defining the passage 61 for a thread to be dispensed to the needles of the needle-bearing organ. A dispensing element 60 according to the present invention will be described in detail in the following.

As shown by way of example in FIG. 1-8, the body 2 of the device can comprise a plurality of the above-mentioned seatings 3, distinct from one another, each configured so as to movably house respective thread guide means internally of the body. Each of the respective thread guide means comprises at least a respective thread guide and respective activating means configured so as to position the respective thread guide in a plurality of operating positions with respect to the seating thereof and with respect to the needle-bearing organ of the knitting machine. In other words, a single device 1 can internally contain a plurality of thread guides, each moved by respective command levers and activating means dedicated thereto. For this purpose the body can comprise a plurality of seatings, each of which is dedicated to a single thread guide (and to the thread guide means and activating means thereof).

FIGS. 1-8 illustrate an example configuration of a device 1 which comprises a plurality of thread guides, among which can be identified: three thread guides of the oscillating type, object of the present invention and described above, three thread guides of the non-oscillating type and two lateral thread guides, also of the non-oscillating type. The three oscillating thread guides can each have two or three actuators, i.e. they can operate between four positions (A-D) or six positions (A-F). The five thread guides of the non-oscillating type are not further described as they are of a known type in the sector. By "non-oscillating" thread guides is meant a thread guide which does not perform a radial nearing and distancing movement with respect to the needle-bearing organ, but only a movement between two or more vertical heights, or a thread guide which, in passage between two vertical heights, can vary the radial position (typically nearing or distancing with respect to the needle-bearing organ), but does not include a selective and controlled radial movement between two points having substantially the same vertical height.

The number of oscillating and non-oscillating thread guides can vary according to the knitting requirements: in a same seating of the device both an oscillating and a non-oscillating thread guide can be mounted and possible replaced.

In the following the structure of the device body of the present invention will be described in greater detail.

As illustrated above, the body 2 of the device is provided with at least a housing seating configured so as to movably house thread guide means in the body: this seating is shaped so as to guide the movement of the thread guide means, in particular guiding the movement of the thread guide 6 in the movement thereof between the plurality of operating positions (A-F), and so as to guarantee the maintaining of each operating position assumed by the thread guide during the working of the knitting machine.

The body 2 develops longitudinally between a rear side 41, destined to house command means 35, for example solenoids 36, configured so as to command the activating means 13, and a front side 42, facing towards the needle-bearing organ of the knitting machine.

Figure 6:
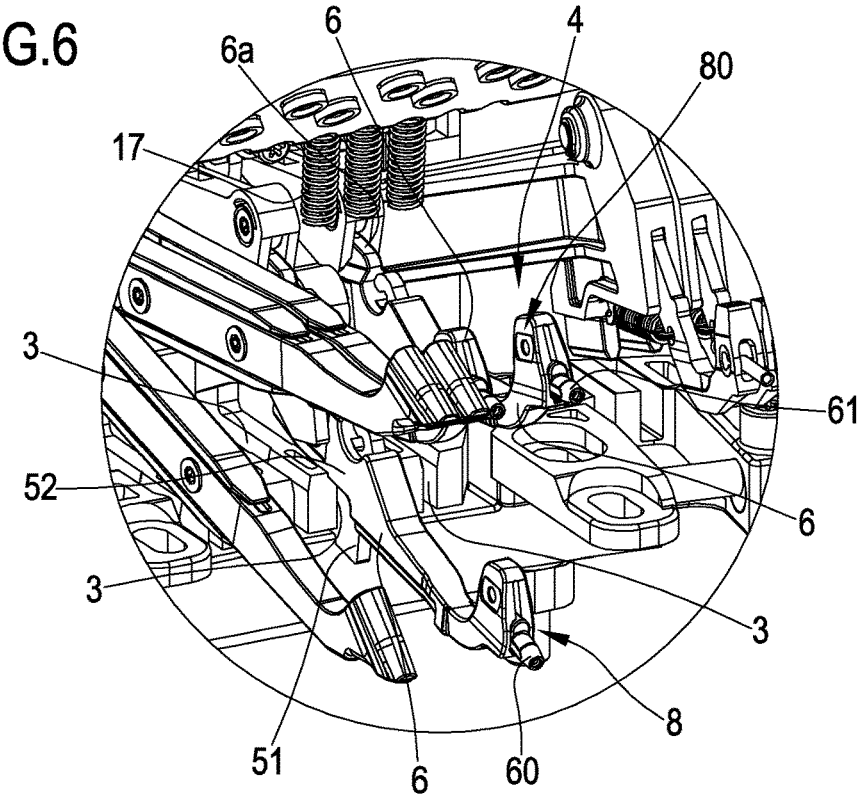
FIG. 6 is a larger-scale detail of a front portion of the device of FIG. 1.
Figure 7:
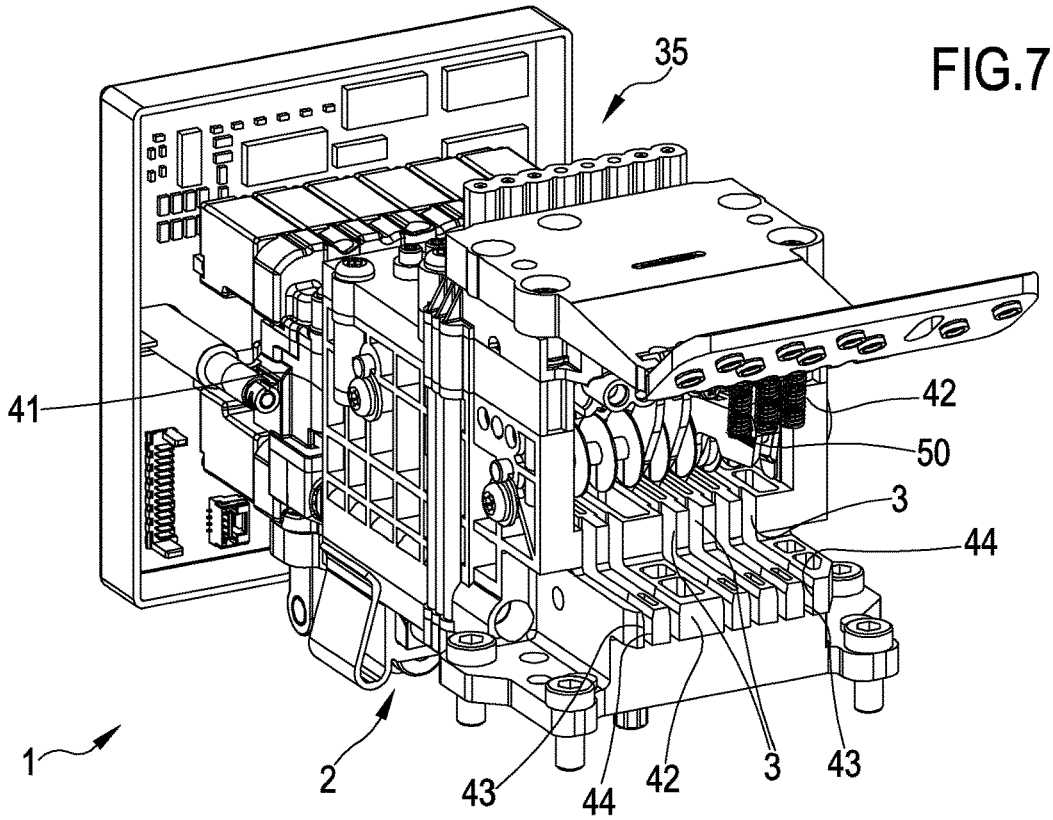
FIG. 7 is a further perspective view of the device of FIG. 1, with some parts removed.

As visible in particular in FIGS. 6 and 7, the seating develops longitudinally at least along a tract of the body from the rear side 41 to the front side 42 and is open on the front side.

The seating preferably develops in the body leaving a free space 50, in particular in a central portion of the longitudinal or vertical development thereof, at the fulcrum of the first lever and where the second lever extends. The seating preferably does not extend in a central portion of the body in which the pivot 16 is housed in a fixed position.

The seating preferably defines an operating plane P on which the thread guide means lie and/or are mobile in the seating; the operating plane P has a substantially parallel development to the orientation of the needles of the needle-bearing organ. The longitudinal development of the seating lies on the operating plane.

The operating plane of the seating is preferably such as to be, with the device mounted, aligned to the needles of the knitting machine.

The seating is preferably singly dedicated to movably house a single thread guide.

As shown by way of example in FIGS. 1-9, the seating 3 is shaped as a recess, or groove, realized in the body of the device, and comprises two facing lateral walls 43 and 44, preferably parallel to one another, configured such as to slidably house the thread guide means.

The two lateral walls are preferably substantially identical and each exhibit a respective lower portion. The two lower portions are facing and shaped so as to guide from the sides the movement of the thread guide 6, parallel to the walls, during the movement thereof among the various operating positions, laterally containing it internally of the seating. Preferably, the distance between the lateral walls of the seating is substantially identical to a thickness of the thread guide, perpendicular to the longitudinal development, so that the thread guide, in the movement thereof between the operating positions, in particularly nearingly and distancingly with respect to the needle-bearing organ, moves substantially in contact with the lateral walls 43 and 44 of the seating 3, and parallel to the walls, preventing lateral oscillations or transversal oscillations with respect to the walls of the thread guide.

As shown by way of example in the figures (and as is visible in particular in FIG. 10), the thread guide can be realised in two distinct portions solidly constrained to one another, which realize the whole thread guide 6 between the rear end 7 and the front end 8 thereof. A first portion 51 extends between the rear end and a central portion of the thread guide and has a first thickness (perpendicular to the longitudinal development thereof). Optionally the first portion 51 of the thread guide can comprise a hooked protuberance to which the lower end of the first elastic element is hooked or mounted.

The thread guide can further comprise a second portion 52 stably mounted to the first portion and extending between a central portion of the thread guide and the front end 8; the second portion has a second thickness (perpendicular to the longitudinal development thereof), preferably greater than the first thickness of the first portion. The second portion 52 preferably partially surrounds, at the central portion of the thread guide, the first portion 51. The second portion 52 preferably exhibits the back 6*a* of the thread guide (i.e. the "fin" of the thread guide) and the above-mentioned guide portion 9.

The distance between the lateral walls 43 and 44 of the seating 3 is substantially equal to the first thickness, i.e. to the thickness of the first portion 51 of the thread guide 6.

The seating, in particular the distance between the lateral walls 43 and 44 of the seating 3, is preferably dimensioned such that the thread guide 6, inserted movably internally of the seating, is laterally separated from the lateral wall, in particular from at least a portion thereof, by a space or gap of at least 1 hundredth of a millimetre and/or at least 5 hundredths of a millimetre, and/or at least 1 tenth of a millimetre and/or at least 2 tenths of a millimetre and/or at least 5 tenths of a millimetre and/or at least 1 millimetre with respect to each wall.

The seating 3 is preferably configured so as to guide the movement of the thread guide 6 from inside the body, in particular along the operating plane P.

The seating (3) is preferably configured so as to guide the movement of the thread guide from inside the body by means of a lateral containing, between the two facing lateral walls 43, 44, at least of the rear end 7 of the thread guide.

The seating 3 is preferably configured so as to guide the movement of the thread guide from the sides without interacting with the front end 8 thereof.

The seating 3 is preferably configured to guide the movement of the thread guide from inside by means of a lateral containing, between the two facing lateral walls 43, 44, of a fraction of the longitudinal extension thereof, by the rear end 7, by at least 10% and/or at least 20% and/or at least 40% and/or at least 60% and/or at least 80% of the longitudinal development thereof.

The fraction of longitudinal extension of the thread guide from the seating is preferably continuous and without interruptions.

The seating 3 is preferably configured to guide the movement of the first lever from the sides, in particular at least of the upper end and/or the lower end of the first lever. The upper portions of the two walls of the seating preferably contain and guide from the sides the upper end 5*b* of the first lever, and/or the lower portions of the two walls of the seating contain and guide from the sides the lower end 5*b* of the first lever.

The seating preferably does not guide or contain from the sides the movement of the second lever, which is positioned at the free space of the seating.

The guide end 12 of the second lever 10 preferably comprises a respective fork configured to at least partially slidably house the guide portion 9 of the thread guide, so as to guide the motion from the sides in contact with the end of the guide of the second lever, and prevent lateral oscillations of the guide portion.

The fork of the guide end 12 enables the thread guide to be continued to move internally of the seating aligned with the operating plane of the seating.

The fork of the guide end of the second lever comprises a recess, in which the guide portion of the thread guide is slidably inserted, and two guide walls between which the recess is interposed, the guide walls containing the thread guide from the two sides and being preferably aligned vertically with the two walls of the seating of the body housing the thread guide.

The fork of the guide end 12 of the second lever realises an upper guide for the thread guide, which completes the guide function carried out inferiorly of the lower portions of the two lateral walls of the seating. Overall the seating and the fork of the second lever guide with precision—both superiorly and inferiorly—the thread guide and prevent any oscillating motion (in particular lateral) of the thread guide both dynamically, during the movement of the thread guide, and statically, in each of the above-mentioned operating positions assumed by the thread guide.

The lateral walls 43 and 44 preferably each exhibit a respective upper portion. The upper portions face one another and are configured so as to guide from the sides the movement of the first thread guide lever, or at least the upper end 5*b* of the first lever, internally of the seating, preventing lateral oscillations, or transversal oscillations with respect to the walls, of the first lever. As visible in FIGS. 8*a* and 9*a*-9*f*, the first lever has the upper end 5*b* and the lower end 5*a* surrounded laterally by the upper portions of the walls of the seating, while it is free (i.e. not laterally flanked to the seating), at the central portion 5*c*, where it is pivoted to the body (in particular it is pivoted on the second lever by a forked mounting, and the body 2 is mounted with it). Each of the lateral walls 43, and 44 preferably has the upper portion thereof aligned vertically with the respective lower portion.

As described above, the body can advantageously comprise a plurality of seatings, distinct from one another and each configured to guide respective guide means.

The seatings of the body of the device preferably exhibit respective longitudinal developments parallel to one another, i.e. they define respective operating planes parallel to one another and parallel to the orientation of the needles of the needle-bearing organ.

The respective first lever and second lever of a plurality of thread guides of the device (preferably the levers of all the thread guides present) are preferably pivoted to the pivot 16 of the body 2.

As can be seen in the figures, the body is advantageously predisposed with seatings of the above-described type even where there are thread guides of the non-oscillating type present, which in themselves do not require laterally guiding as they do not perform roto-translating and radial movements (they do not move to and fro). Should it be necessary to replace non-oscillating thread guides with oscillating thread guides (in one or more positions), this means already having profiled seatings for laterally guiding the oscillating thread guides, with considerable advantages in terms of performance and stability. The seatings of the present invention are configured such as to laterally guide all types of oscillating thread guide, of both known type and of the "bar-linkage" type of the present invention.

Note that, in the scope of the present description and claims, the term "seating" is used to identify, primarily, substantially a "logical" concept internally of the device: the term "seating" in general identifies the portion of body of the device destined to a single thread guide and the respective activating means thereof, which command movement thereof. According to the embodiments, the technical characteristic of the seating is enriched with structural characteristics, such as the walls, which define how the seating interacts with the thread guide means, and in particular with the thread guide, guiding the movement thereof with respect to the device body. An important aspect relates to the definition of a plurality of seatings internally of the body 2, each associated independently to a thread guide. In the embodiment illustrated by way of example in the figures, each of the seatings is clearly destined to respective thread guide means (and therefore to a single thread guide): however zones can exist of the seating that are open and communicating with the adjacent seatings: this is the case of the free space 50 of each seating (vertically interposed between the respective upper portion and the respective lower portion and at which the seating does not interact with the thread guide means): the free spaces of the various seatings communicate with one another to form a free space (internally of the body) transversally crossing all the seatings. This shows that the seatings can be not completely circumscribed or defined spatially, but are defined by respective thread guide means with which they cooperate, and in particular by the thread guide thereof which they guide in the movement thereof among the plurality of operating positions.

The above-mentioned body of the device is realised in a single piece, at least in the part thereof comprising the seatings (i.e. all the seatings are afforded in a single piece of the body). Alternatively, the body of the device can be realized by assembly of several parts, in such a way as to facilitate the assembly operations of the components of the device. For example, the body can comprise a main block, which comprises at least the lower portions of the pairs of walls of each seating of the device body and/or the above-mentioned free space, and an upper plate, which comprises the upper portions of the pairs of walls of each seating and is mountable on the main block such as to complete each of the seatings.

FIG. 1-8 show the command and control part of the device 1 of the present invention. The command means 35 of the device comprise a plurality of solenoids 36, which command the actuators of the activating means acting on levers and thread guides, and an electronic board 37 which interfaces the device with a central unit of the knitting machine (not illustrated). The electronic board can receive the instructions relative to the management of the device by the central unit of the knitting machine.

The electronic board 37 can comprise a connecting portion 39 (for example a network port or a field bus port) configured such as to enable connection of the device 1 to the central unit of the knitting machine. The device can further comprise a casing 38 housing the electronic board.

In the following a further object of the present invention is described, independent of the preceding, i.e. a dispensing element 60 for thread guides for knitting machines. By way of example an embodiment of the dispensing element is shown in FIGS. 10, 11, 12.

The dispensing element 60 of the thread is in general destined to be mounted to the front end of a thread guide, for example to the front end 8 of the thread guide 6 of the present invention, but can also be used with known-type thread guides: regardless of the type of thread guide, the dispensing element defines internally thereof the passage 61 for a feeding thread of the needles of a knitting machine. The dispensing element 60 comprises a body 62 having a mounting portion 63, destined to be removably mounted to a front end of a thread guide, and an operating portion 64, destined to be facing towards the needles of the needle-bearing organ of the knitting machine.

The peculiarity of the dispensing element of the present invention is that the mounting portion 63 enables mounting the whole dispensing element to the thread guide in a determined discrete number of configurations with respect to the thread guide, to which correspond a same discrete number of positions assumed by the operating portion of the dispensing element with respect to the needles of the needle-bearing organ. The dispensing element can be mounted selectively to the thread guide exclusively in a configuration selected from among the determined discrete number of configurations.

The mounting portion 63 is further destined to be inserted in a mounting seating 70 of the thread guide complementarily shaped to the mounting portion, such that the mounting portion of the element is at least partially wound by the mounting seating of the thread guide. In the figures the mounting seating 70 circumferentially surrounds the mounting portion 63.

The mounting seating 70 preferably consists in a through-hole 71 which crosses the front end 8 of the thread guide 6.

The mounting portion 63 preferably enables mounting the dispensing element 60 by means of an axial insertion in the mounting seating of the thread guide.

The dispensing element 60 has an elongate conformation and develops longitudinally between a rear end 65, from which the mounting portion 63 develops, and a front end 66, at which the operating portion 64 terminates.

The body 62 of the dispensing element is provided with a longitudinal hole 67 passing through the whole body of the rear end 65, is in general from the mounting portion 63, the front end 66, or in general the operating portion 64: the hole is slidably crossed by an infeed thread for the needles of the knitting machine. The longitudinal hole 67 defines and realizes the passage 61 for the infeed thread.

The mounting portion 63 preferably develops along a longitudinal axis 63*a* and has a second 69, preferably constant, not circular and able to prevent the rotation of the mounting portion internally of the seating, in particular with respect to a rotation axis that is parallel to, or coincident with, the longitudinal axis of the mounting portion.

The section 69 of the mounting portion is preferably configured to enable insertion in the seating only according to the discrete number of configurations. The section is polygonal or elliptical or made up of curved tracts intervalled by straight tracts. In the embodiment shown in the figures the section is made up of two straight vertical tracts (having a same length) connected superiorly and inferiorly by two substantially semi-circular tracts. In general, the mounting portion has a section that is such as to realize a snug fitting with the complementarily-shaped seating of the thread guide, such as to prevent rotation of the dispensing element with respect to the seating of the thread guide.

Each of the positions of the above-mentioned discrete number of positions assumed by the operating portion of the dispensing element with respect to the needles of the needle-bearing organ is preferably characterised by a respective distance from the needles of the machine and a respective orientation assumed with respect to the needles of the knitting machine.

Preferably, as in the embodiment shown by way of example in the figures, the above-mentioned determined discrete number of mounting configurations is exactly two: the mounting portion can be mounted to the thread guide in a first mounting configuration, to which corresponds a low position of the operating portion, or in a second mounting configuration, to which corresponds a high position of the operating portion. In this case the conformation of the mounting portion does not enable other mounting configurations from the two above-described ones.

In the second mounting configuration the dispensing element is arranged oppositely with respect to the arrangement assumed in the first mounting configuration, i.e. between the first and the second mounting configuration the mounting portion is rotated by 180°.

The high position of the operating portion preferably corresponds to a position known in the sector as a traditional position, while the low position also corresponds, mainly though not exclusively, to a traditional position, but below the needle tongues. The dispensing element is typically used in the low position for the thread guides operating between six positions (A-F), while the mounting for the high position is used for the thread guides operating between four positions (A-D). The selection of the mounting configuration of the dispensing element typically mainly occurs on the basis of the type of thread guide on which the element is mounted. However, the selection of the mounting configuration of the dispensing element can be determined, additionally or alternatively, also on the basis of the knitting operations to be realized.

The high position and the low position selectively assumed by the operating portion are preferably vertically aligned along a vertical axis substantially parallel to the needles present in the needle-bearing organ of the knitting machine.

The mounting portion 63 is preferably characterised by a bilateral symmetry, i.e. it is symmetrical with respect to a plane of symmetry passing through the longitudinal axis of the mounting portion. In the case shown in the figures the symmetry is with respect to a vertical plane XIIa-XIIa.

The longitudinal hole 67 is preferably open on the rear end 65, defining a first opening 75, and is open on the front end 66, defining a second opening 76: the first opening enables inserting the infeed thread into the dispensing element and the second opening enables exit, towards the needles of the knitting machine, of the feeding thread.

The second opening (or the centre thereof) is preferably dealigned from the first opening (or the centre thereof) with respect to the longitudinal axis 63*a* of the mounting portion. The first opening 75 is preferably coaxial to the longitudinal axis 63*a*.

In the first mounting configuration the second opening 76 is preferably lower than the first opening 75 with respect to the longitudinal axis 63*a*, and in the second mounting configuration the second opening 76 is higher than the first opening with respect to the longitudinal axis 63*a*.

The operating portion 64 preferably extends from the mounting portion 63 and is dealigned with respect thereto, in particular it has a respective longitudinal axis 64*a* transversal to the longitudinal axis of the mounting portion.

The operating portion 64 is preferably inclined with respect to the mounting portion 63 in such a way that the longitudinal axis 64*a* of the operating portion forms, with the longitudinal axis 63*a* of the mounting portion, an angle of less than 5° and/or less than 10° and/or less than 20° and/or less than 45° and/or less than 90°. The operating portion 64 is preferably arranged obliquely with respect to the mounting portion, and the dispensing element is asymmetrical with respect to the longitudinal axis 63*a* of the mounting portion. The operating portion is substantially asymmetric with respect to the mounting portion.

The mounting configuration is preferably selected during the inserting step of the mounting portion in the mounting seating, internally of which all rotation of the dispensing element is prevented with respect to the thread guide. Therefore once the mounting portion is inserted in the mounting seating, the configuration of the dispensing element is fixed; to modify the configuration it is first necessary to remove the dispensing element from the thread guide (de-inserting it from the mounting seating 70), and thus re-insert it in the desired configuration.

The axial position of the mounting portion 63 internally of the seating 70 of the thread guide (i.e. the position thereof along the longitudinal axis 63*a*) can preferably be selectively varied during the mounting step, in such a way as to vary the distance between the operating portion 64 and the needles of the knitting machine.

The dispensing element 60 is preferably realised in a ceramic material or zircon. In this way the dispensing element exhibits a high resistance to wear in the sliding of the thread on the internal surface of the longitudinal hole. As shown in the figures, the dispensing element is preferably made in a single piece.

The longitudinal hole 67 preferably has a conical extension and/or exhibits a section narrowing or a tapering starting from the first opening 75 in the rear end 65 up to the second opening 76 in the front end 66.

FIGS. 10 and 11 show a thread guide 6 housing a dispensing element at the front end thereof. The thread guide comprises blocking means 80 arranged at the mounting seating 70 and configured to removably engage with the mounting portion 63 of the dispensing element, with the aim of stably and removably mounting it in the mounting seating. The blocking means preferably comprise a screw 81, or grub screw, insertable in a hole 82, preferably threaded, defined in the front end of the thread guide and oriented in such a way as to be transversal, preferably perpendicular, to the mounting portion of the dispensing element once inserted in the mounting seating.

The blocking means 80 preferably comprise an abutting element 83 cooperating with the screw 81 so as to block the mounting portion of the dispensing element in the mounting seating. The screw 81 and the abutting element 83, operating in the hole, overall realize a clamped mounting of the mounting portion of the dispensing element.

The hole 82 is preferably a through-hole in the front portion of the thread guide. The screw and the abutting element are preferably inserted in opposite sides of the hole, such as to act on the opposite sides of the mounting portion of the dispensing element.

The invention as it is conceived is susceptible to numerous modifications and variants, all falling within the ambit of the inventive concept, and the mentioned components can be replaced with others that are technically equivalent. The invention provides important advantages.

Primarily the invention enables obviating at least some of the drawbacks of the prior art.

Further, the device of the present invention enables positioning the thread guides precisely and effectively obtaining the knitting functions required by knitting machines (both new and already in existence).

Further, the device of the present invention is characterised by a movement of the single thread guides that is stable and not significantly subject to vibratory phenomena.

Further, the device of the present invention enables positioning the dispensing end of the thread of each thread guide selectively in a multiplicity of positions, increasing the versatility of use in various knitting machines and for different production needs. Further, the device of the present invention is characterised by a competitive cost and a high degree of functioning reliability. Further, the thread dispensing element of the present invention is able to obviate one or more of the drawbacks of the prior art. Further, the thread dispensing element of the present invention is able to realize an extremely precise and stable mounting on a respective thread guide, so as to assume a determined position and a specific orientation with respect to the needles of the machine and to maintain them over time. The device 1, in its various aspects, the dispensing element 60 and the thread guide 6 of the present invention are further simple and/or sturdy and have a modest realization cost with respect to the performance and quality provided.

The invention claimed is:

1. A device (1) for feeding thread to the needles (N) of a knitting machine, the device comprising:

a body (2) of the device configured to be mounted to a knitting machine, at a needle-bearing organ of the knitting machine, thread guide members (4), movably housed at least partially in said body (2), wherein the thread guide members comprise:

a first lever (5) rotatably mounted to said body (2) of the device so as to be able to rotate about a first rotation axis (X);

a thread guide (6) rotatably mounted to said first lever (5) so as to be able to rotate, with respect to said first lever, about a second rotation axis (Y), said thread guide (6) having an elongate shape and extending longitudinally between a rear end (7) and a front end (8), the front end (8) projecting and emerging from said body (2) in a direction of said needle-bearing organ and defining at least a passage (61) for a thread to be dispensed to the needles (N) of said needle-bearing organ, said thread guide being provided with a guide portion (9) interposed between the rear end (7) and the front end (8);

a second lever (10) rotatably mounted to said body (2) of the device so as to be able to rotate about a third rotation axis (Z), the second lever longitudinally extending between an activating end (11) and a guide end (12), said guide portion (9) of the thread guide (6) being configured to stay slidably in contact with said guide end of the second lever;

activating members (13) positioned at least partially in said body (2) and configured and predisposed for controlledly moving at least said first lever (5) and said second lever (10) so as to position the thread guide (6) in a plurality of operating positions with respect to the body and with respect to the needle-bearing organ of the knitting machine, wherein the thread guide members (4) are characterised in that the first lever (5), the second lever (10) and the thread guide (6) together realise a four-bar linked kinematic structure configured so as to selectively position the front end (8) of the thread guide (6) in the plurality of operating positions, and wherein the four-bar linked kinematic structure is kinematically defined by the first rotation axis (X), the second rotation axis (Y), a direct contact point between the guide portion (9) of the thread guide (6) and the guide end (12) of the second lever (10), and the third rotation axis (Z).

2. The device (1) of claim 1, wherein the activating members (13) comprise a first actuator (14) activatable on the first lever (5) to determine a rotation thereof about the first rotation axis (X) of a first regulatably-variable angle between an advanced position and a retracted position, to which correspond respectively a displacement of the front end (8) of the thread guide distancingly from the needle-bearing organ and a displacement of the front end (8) of the thread guide nearingly to the needle-bearing organ, the displacements occurring in a range of motion and a trajectory being a function of the shape of the guide portion of the thread guide; and wherein the activating members (13) comprise a second actuator (15) activatable on the second lever (10) so as to determine a rotation thereof, about the third rotation axis (Z) of a second regulatably-variable angle, between a first position and a second position, to which correspond respectively a displacement of the front end (8) of the thread guide (6) in a rising direction with respect to the needle-bearing organ, up to a first vertical height (101), and a displacement of the front end (8) of the thread guide (6) in a lowering direction with respect to the needle-bearing organ, to a second vertical height (102) lower than the first vertical height.

3. The device (1) of claim 1, wherein the thread guide members (4) comprise elastic members positioned at least partially in the body (2) and configured and predisposed to elastically oppose the movement imparted on the first lever (5) and on second lever (10) by the activating members (13).

4. The device (1) of claim 2, wherein the activating members comprise a third actuator (19) acting on the second lever (10) to determine a further rotation thereof, about the third rotation axis (Z) of a third regulatable angle, between the first or second position and a third position, in which to the further rotation of the second lever so as to bring itself into the third position corresponds a displacement of the front end (8) of the thread guide in a lowering direction with respect to the needle-bearing organ, up to a third vertical height (103) lower than the second vertical height (102).

5. The device (1) of claim 1, wherein the thread guide (6) is rotatably hinged to the first lever (5) at the rear end (7) of the thread guide (6) and wherein the thread guide (6) is rotatably hinged to a lower end (5*a*) of the first lever (5), and wherein the rear end (7) of the thread guide and the lower end (5*a*) of the first lever realize a cylindrical joint (20) which enables relative rotation between the thread guide and the first lever at least about the second rotation axis (Y).

6. The device (1) of claim 1, wherein the thread guide (6) exhibits a back (6*a*) at a thickness of the thread guide, the thickness developing perpendicularly to the longitudinal development of the thread guide and the back being in an upper position in the thread guide, and the guide portion (9) of the thread guide is defined on the back of the thread guide and comprises a portion of an upper surface of the thread guide which extends in the direction of the longitudinal development of the thread guide, and wherein the portion of upper surface defining the guide portion develops on planes that are substantially parallel to the second rotation axis of the thread guide with respect to the first lever.

7. The device (1) of claim 4, wherein the plurality of operating positions of the thread guide (6) comprises one or more of the following operating positions:

a first operating position, obtained by activation of the first actuator (14) and deactivation of the second actuator (15), wherein the front end (8) of the thread guide is positioned in a first point (A) in which the thread guide is prepared for lowering towards the second vertical height and the third vertical height;

a second operating position, obtained by deactivation of the first (14) and the second actuator (15), wherein the front end of the thread guide is positioned in a second point (B) in which either the possibility of an uptake of the thread by the needles (N) of the knitting machine is excluded, or the thread, previously dispensed to the needles of the machine, is brought posteriorly of the needle head;

a third operating position, obtained by activation of the first (14) and the second actuator (15), in which the front end of the thread guide is positioned in a third point (C) in which all the needles (N) of the knitting machine can take up the thread;

a fourth operating position, obtained by deactivation of the first actuator (14) and activation of the second actuator (15), in which the front end of the thread guide is positioned in a fourth point (D) in which uptake is enabled only for the needles (N) of the knitting machine which are raised more than other needles, which other needles are raised less and therefore do not take up the thread;

a fifth operating position, obtained by activation of the first (14) and the third actuator (19), in which the front end of the thread guide is positioned in a fifth point (E) in which thread take-up is enabled for all the needles (N) of the knitting machine, which needles (N) are brought into working condition at the desired infeed;

a sixth operating position, obtained by deactivation of the first actuator (14) and activation of the third actuator (19), in which the front end of the thread guide is positioned in a sixth point (F) in which take-up of the thread is enabled only for the needles (N) of the knitting machine which are raised less, while thread take-up is disabled for the needles (N) which are raised more, as the infed thread is positioned lower than the tongue of the latter needles (N).

8. The device (1) of claim 1, wherein the body (2) is provided with at least a housing seating (3) and wherein the thread guide members (4) are located at least partly within the housing seating, in which the first lever (5) and the second lever (10) are rotatably mounted to the body internally of the housing seating, the front end (8) of the thread guide projects and emerges from the housing seating in the direction of the needle-bearing organ and the activating members are positioned internally of the housing seating, or wherein the body (2) comprises a plurality of the housing seatings (3), distinct from one another, each of the housing seatings being configured to movably house respective thread guide members (4) in the body, each of the respective thread guide members comprising at least a respective thread guide (6) and respective activating members (13) configured so as position the respective thread guide in a plurality of operating positions with respect to the housing seating and with respect to the needle-bearing organ of the knitting machine.

9. A knitting machine for knitwear or hosiery, comprising a needle-bearing organ exhibiting a plurality of flanked grooves extending substantially vertically, each groove movably housing a needle (N) mobile on command in the respective groove for the formation of fabric, and comprising a device (1) for feeding thread to the needles, the device comprising:

a body (2) of the device configured to be mounted to a knitting machine, at a needle-bearing organ of the knitting machine, thread guide members (4), movably housed at least partially in said body (2), wherein the thread guide members comprise:

a first lever (5) rotatably mounted to said body (2) of the device so as to be able to rotate about a first rotation axis (X);

a thread guide (6) rotatably mounted to said first lever (5) so as to be able to rotate, with respect to said first lever, about a second rotation axis (Y), said thread guide (6) having an elongate shape and extending longitudinally between a rear end (7) and a front end (8), the front end (8) projecting and emerging from said body (2) in a direction of said needle-bearing organ and defining at least a passage (61) for a thread to be dispensed to the needles (N) of said needle-bearing organ, said thread guide being provided with a guide portion (9) interposed between the rear end (7) and the front end (8);

a second lever (10) rotatably mounted to said body (2) of the device so as to be able to rotate about a third rotation axis (Z), the second lever longitudinally extending between an activating end (11) and a guide end (12), said guide portion (9) of the thread guide (6) being configured to stay slidably in contact with said guide end of the second lever;

activating members (13) positioned at least partially in said body (2) and configured and predisposed for controlledly moving at least said first lever (5) and said second lever (10) so as to position the thread guide (6) in a plurality of operating positions with respect to the body and with respect to the needle-bearing organ of the knitting machine, wherein the thread guide members (4) are characterised in that the first lever (5), the second lever (10) and the thread guide (6) together realise a four-bar linked kinematic structure configured so as to selectively position the front end (8) of the thread guide (6) in the plurality of operating positions, and wherein the four-bar linked kinematic structure is kinematically defined by the first rotation axis (X), the second rotation axis (Y), a direct contact point between the guide portion (9) of the thread guide (6) and the guide end (12) of the second lever (10), and the third rotation axis (Z), the needle-bearing organ being mobile with respect to the device for feeding thread along a motion trajectory.

10. The device (1) of claim 3, wherein the elastic members comprise a first elastic element (17) having an end constrained to the body (2) and an opposite end constrained to the thread guide (6), the first elastic element (17) being configured to determine a tensioning of the thread guide (6) towards the second lever (10) and to maintain the guide portion (9) of the thread guide in contact with the guide end (12) of the second lever (10), and wherein the first elastic element (17) is configured to determine a tensioning of the thread guide (6), towards the first vertical height, so as to transmit, by the guide portion (9) of the thread guide in contact with the guide end (12) of the second lever, a thrust on the second lever (10) towards the first position thereof.

11. The device (1) of claim 10, wherein the first elastic element (17) is configured to oppose the action at least the second actuator (15), maintaining the second lever (10) in the respective first position when the second actuator does not act on the second lever, and wherein the elastic members comprise a second elastic element (18) having an end constrained to the body (2) and an opposite end constrained to the first lever (5), the second elastic element (18) being configured to determine a tensioning of the first lever (5) towards the retracted position and to oppose the action of the first actuator (14), maintaining the first lever in a retracted position when the first actuator does not act on the first lever.

12. The device (1) of claim 1, wherein the first lever and the second lever are rotatably mounted to a same point of the body (2), in which case the first rotation axis (X) and the third rotation axis (Z) coincide, and wherein the first rotation axis (X) is orientated substantially parallel to the tangent to the motion trajectory of the needle-bearing organ relatively to the body (2), and wherein the second rotation axis (Y) is substantially parallel to, and distinct from, the first rotation axis (X).

13. The device (1) of claim 4, wherein the activation of the third actuator (19) enables rotating the guide end of the second lever in a downwards direction, bringing it into the third position, and the passage of the second lever into the third position can occur both starting from the first position, and starting from the second position, when starting from the first position the third actuator moving the second lever—in a lowering direction—from the first height directly to the third vertical height, while when starting from the second position the third actuator moving the second lever—in a lowering direction—from the second height to the third vertical height.

14. The device (1) of claim 1, wherein the activating members (13) are active on the first lever (5) and on the second lever (10) and do not directly interact with the thread guide (6).

15. The device (1) of claim 2, wherein the thread guide members (4) comprise a third lever (30) rotatably mounted to the body (2) in such a way as to be able to rotate about a fourth rotation axis (W), the third lever (30) comprising an activating portion (31), which the second actuator (15) can act, and a thrust portion (32), the thrust portion being configured to interact with the activating end (11) of the second lever (10) so as to determine the rotation of the second lever about the third rotation axis (Z) between the first position and the second position.

16. The device (1) of claim 5, wherein the cylindrical joint (20) comprises a protrusion (21) having a conformation, in a perpendicular section to the second axis (Y), at least partially circular, and comprises a recess (22) complementarily-shaped to the protrusion (21) and configured to house the protrusion so as to enable rotation thereof internally of the recess, and wherein the protrusion (21) emerges from and is solidly constrained to or in a single piece with the first lever and the recess (22) is fashioned in the thread guide, or the protrusion (21) emerges from and is solidly constrained to or in a single piece with the thread guide and the recess (22) is fashioned in the first lever.

17. The device (1) of claim 1, wherein the guide end (12) of the second lever (10) comprises a bearing (23) or roller configured to enable or facilitate sliding of the guide portion (9) of the thread guide with respect to the guide end (12) of the second lever.

18. The device (1) of claim 6, wherein the guide portion (9) on the back (**6*a*) of the thread guide is maintained pressed, with a determined force, on the guide end (12) of the second lever (10) by the first elastic element (17**), which prevents detachment of the thread guide from the second lever.

19. The device (1) of claim 6, wherein the thread guide comprises a fin emerging superiorly from the thread guide and developing over a longitudinal portion of the thread guide, parallel to the longitudinal axis of the thread guide, the back of the thread guide being defined on the fin or coinciding with an upper surface of the fin, and wherein the guide portion is defined on an upper surface of the fin.

20. The device (1) of claim 7, wherein the thread guide (6) comprises a foot (55) configured to cooperate with a stop (57) of the device for halting a radial advancement of the thread guide, nearingly to the needle-bearing organ, in the motion thereof towards the fourth position (D), or towards the sixth position (F), in this way defining the respective radial distance of the front end (8) from the needle-bearing organ in the fourth position (D) or sixth position (F), the foot (55) being positioned inferiorly of the thread guide and in an intermediate position between the rear end and the front end, the foot (55) of the thread guide (6) comprising a front surface (56), configured to enter into contact with the stop (57) and to cause halting of the radial motion of the thread guide towards the needle-bearing organ, and wherein the front surface of the foot is shaped or profiled in such a way that when the foot (55) is in contact with the stop (57), a vertical movement of the thread guide determines a thrust by the stop on the front surface of the foot, the thrust causing a radial displacement of the foot and the whole thread guide according to a trajectory which is a function of the shaping or profiling of the front surface of the foot.

* * * * *